US008894468B2

(12) United States Patent
Hashish et al.

(10) Patent No.: US 8,894,468 B2
(45) Date of Patent: Nov. 25, 2014

(54) FLUID JET RECEPTACLE WITH ROTATABLE INLET FEED COMPONENT AND RELATED FLUID JET CUTTING SYSTEM AND METHOD

(75) Inventors: Mohamed A. Hashish, Bellevue, WA (US); Steven J. Craigen, Auburn, WA (US); Bruce M. Schuman, Auburn, WA (US); Eckhardt R. Ullrich, Kent, WA (US)

(73) Assignee: Flow International Corporation, Kent, WA (US)

( * ) Notice: Subject to any disclaimer, the term of this patent is extended or adjusted under 35 U.S.C. 154(b) by 237 days.

(21) Appl. No.: 13/473,280

(22) Filed: May 16, 2012

(65) Prior Publication Data

US 2013/0306748 A1 Nov. 21, 2013

(51) Int. Cl.
*B24C 1/08* (2006.01)

(52) U.S. Cl.
USPC ..... 451/87; 451/38; 451/75; 451/442; 451/453

(58) Field of Classification Search
CPC ..... B24C 3/065; B24C 3/067; B24C 9/003; B24C 9/006; B24B 55/06; B23Q 11/0046; B26F 3/008
USPC ..... 451/38–40, 2, 75, 78, 87, 442, 453, 451/457; 83/53, 177
See application file for complete search history.

(56) References Cited

U.S. PATENT DOCUMENTS 2,039,695 A * 5/1936 Watt ..... 144/145.2
2,462,480 A * 2/1949 Eppler ..... 451/40
2,985,050 A * 5/1961 Schwacha ..... 83/53
3,730,040 A 5/1973 Chadwick et al.
3,818,774 A * 6/1974 Schnekenburger et al. .... 74/125
4,207,710 A * 6/1980 Fournier ..... 451/399
4,435,902 A 3/1984 Mercer et al.
4,532,949 A 8/1985 Frank
4,589,234 A * 5/1986 Rebhan et al. ..... 451/80
4,646,482 A 3/1987 Chitjian
4,651,476 A 3/1987 Marx et al.
4,665,949 A 5/1987 Jordan
4,669,229 A 6/1987 Ehlbeck
4,698,939 A * 10/1987 Hashish ..... 451/87
4,758,284 A * 7/1988 Todd ..... 148/197
4,799,415 A 1/1989 Gerdes (Continued)

FOREIGN PATENT DOCUMENTS

DE 19618523 A1 11/1997
WO 2011/046142 A1 4/2011

*Primary Examiner* — George Nguyen
(74) *Attorney, Agent, or Firm* — Seed IP Law Group PLLC

(57) ABSTRACT

A jet receiving receptacle is provided which is coupleable to a high pressure fluid jet system opposite a nozzle thereof to receive a fluid jet discharged from the nozzle after it acts on a workpiece. The jet receiving receptacle may include an inlet feed component having a tapered inlet that defines a jet receiving surface about a central axis to receive the fluid jet and direct the fluid jet downstream and toward the central axis. The jet receiving receptacle may further include a drive mechanism adapted to rotate the inlet feed component about the central axis such that impact of the fluid jet with the inlet feed component is distributed around the jet receiving surface. The drive mechanism may rotate the inlet feed component continuously or intermittently. Fluid jet cutting systems incorporating a jet receiving receptacle and related methods are also provided.

25 Claims, 12 Drawing Sheets

(56) References Cited

U.S. PATENT DOCUMENTS

| | | | | |
|---|---|---|---|---|
| 4,827,679 | A * | 5/1989 | Earle, III | 451/40 |
| 4,848,042 | A * | 7/1989 | Smith et al. | 451/78 |
| 4,864,780 | A | 9/1989 | Ehlbeck et al. | |
| 4,872,293 | A | 10/1989 | Yasukawa et al. | |
| 4,920,841 | A | 5/1990 | Johnson | |
| 4,937,985 | A | 7/1990 | Boers et al. | |
| 4,955,164 | A * | 9/1990 | Hashish et al. | 451/40 |
| 4,964,244 | A | 10/1990 | Ehlbeck | |
| 5,092,744 | A | 3/1992 | Boers et al. | |
| 5,111,652 | A | 5/1992 | Andre | |
| 5,445,557 | A * | 8/1995 | Gramm et al. | 451/75 |
| 5,527,204 | A * | 6/1996 | Rhoades | 451/40 |
| 5,643,058 | A | 7/1997 | Erichsen et al. | |
| 5,826,813 | A * | 10/1998 | Hibata | 242/383.1 |
| 5,831,224 | A | 11/1998 | Wattles et al. | |
| 5,980,372 | A * | 11/1999 | Spishak | 451/453 |
| 6,332,833 | B1 * | 12/2001 | Ohshima et al. | 451/56 |
| 6,500,058 | B2 | 12/2002 | Bajo et al. | |
| 6,524,171 | B2 | 2/2003 | Voutilainen | |
| 6,719,611 | B2 | 4/2004 | Kordonski et al. | |
| 6,746,309 | B2 | 6/2004 | Tsuihiji et al. | |
| 6,766,216 | B2 | 7/2004 | Erichsen et al. | |
| 7,000,513 | B2 | 2/2006 | Zelinski, Jr. et al. | |
| 7,052,378 | B2 | 5/2006 | Tateiwa et al. | |
| 7,059,940 | B2 * | 6/2006 | Seo et al. | 451/37 |
| 7,389,663 | B2 * | 6/2008 | Cheppe et al. | 72/53 |
| 7,695,348 | B2 | 4/2010 | Mase | |
| 8,322,700 | B2 | 12/2012 | Saberton et al. | |
| 2002/0090897 | A1 * | 7/2002 | Jinbu et al. | 451/61 |
| 2003/0019340 | A1 | 1/2003 | Shaw | |
| 2007/0238393 | A1 | 10/2007 | Shin et al. | |
| 2008/0032610 | A1 * | 2/2008 | Chacko et al. | 451/102 |
| 2008/0242200 | A1 * | 10/2008 | Okada et al. | 451/38 |
| 2009/0098810 | A1 * | 4/2009 | Mase | 451/88 |
| 2009/0140482 | A1 | 6/2009 | Saberton et al. | |
| 2009/0318064 | A1 * | 12/2009 | Hashish | 451/36 |
| 2012/0184185 | A1 | 7/2012 | Kanazawa et al. | |
| 2013/0025425 | A1 | 1/2013 | Knaupp et al. | |

* cited by examiner

FLUID JET RECEPTACLE WITH ROTATABLE INLET FEED COMPONENT AND RELATED FLUID JET CUTTING SYSTEM AND METHOD

BACKGROUND

1. Technical Field

This disclosure is related to fluid jet cutting systems and devices, and, in particular, to compact fluid jet receptacles with rotatable inlet feed components which are positionable to catch a fluid jet discharged from a cutting head of a fluid jet cutting system during workpiece processing operations.

2. Description of the Related Art

Fluid jet or abrasive-fluid jet cutting systems are used for cutting a wide variety of materials, including stone, glass, ceramics and metals. In a typical fluid jet cutting system, a high-pressure fluid (e.g., water) flows through a cutting head having a cutting nozzle that directs a cutting jet onto a workpiece. The system may draw or feed an abrasive into the high-pressure fluid jet to form an abrasive-fluid jet. The cutting nozzle may then be controllably moved across the workpiece to cut the workpiece as desired. After the fluid jet, or abrasive-fluid jet, generically referred to hereinafter as a "waterjet," passes through the workpiece, the energy of the waterjet is often dissipated by a relatively large volume of water in a catcher tank that is also configured to support the workpiece. Systems for generating high-pressure waterjets are currently available, such as, for example, the Mach 4™ five-axis waterjet system manufactured by Flow International Corporation, the assignee of the present application. Other examples of waterjet cutting systems are shown and described in Flow's U.S. Pat. No. 5,643,058, which is incorporated herein by reference in its entirety. Examples of catcher tank systems for supporting workpieces and dissipating energy of a waterjet after it passes through a workpiece are shown and described in Flow's U.S. patent application Ser. No. 13/193,435, filed Jul. 28, 2011, which is incorporated herein by reference in its entirety.

Although many waterjet cutting systems feature a catcher tank arrangement having a large volume of water contained therein to dissipate energy of the waterjet during use, other known systems utilize compact fluid jet receptacles which are positioned opposite a cutting head and moved in unison with the same to catch the jet after it is discharged from the cutting head and acts on a workpiece. Examples of such receptacles (also referred to as catcher cups) and other related devices are shown and described in U.S. Pat. Nos. 4,435,902; 4,532,949; 4,651,476; 4,665,949; 4,669,229; 4,698,939; 4,799,415; 4,920,841; and 4,937,985. Known fluid jet receptacles, however, can suffer from several drawbacks. For example, many fluid jet receptacles are overly complex, bulky and/or prone to premature wear. In addition, many known fluid jet receptacles are configured such that upon wear, fluid and abrasives from the jet may rebound from the receptacle and cause surface defects in the workpiece, excessive noise and/or other hazardous or unwanted conditions.

BRIEF SUMMARY

Embodiments described herein provide fluid jet receptacles and waterjet cutting systems incorporating the same and related methods which are particularly well adapted for receiving a jet during workpiece processing. Other benefits include distributing the jet over a tapered inlet receiving surface to prolong component life and minimize or prevent rebounding of the jet. Embodiments include a jet receiving receptacle having a rotatable inlet feed component which is coupleable to a high pressure fluid jet system opposite a nozzle thereof to receive a fluid jet discharged from the nozzle in a particularly compact form factor or package.

In one embodiment, a fluid jet system adapted to generate a fluid jet under high pressure operating conditions to process a workpiece may be summarized as including a nozzle having a fluid jet outlet to discharge the fluid jet and a jet receiving receptacle positioned opposite the nozzle to receive the fluid jet when processing workpieces. The jet receiving receptacle includes an inlet feed component having a tapered inlet that defines a jet receiving surface about a central axis, the jet receiving surface converging toward the central axis in a downstream direction. The jet receiving surface defined by the tapered inlet may be frustoconical and may have an included angle between about twenty degrees and about seventy degrees. The fluid jet system may further include a drive mechanism adapted to rotate the inlet feed component about the central axis such that impact of the fluid jet with the inlet feed component of the jet receiving receptacle is distributed continuously or intermittingly around the jet receiving surface defined by the tapered inlet. The drive mechanism of the jet receiving receptacle may be adapted to rotate the inlet feed component incrementally or continuously.

According to one embodiment, the drive mechanism of the fluid jet system may include a vane which is adapted to rotate the inlet feed component of the jet receiving receptacle about the central axis in response to a driving fluid. A housing may be provided having a vane chamber to enclose the vane, a driving fluid inlet in fluid communication with the vane chamber to feed the driving fluid toward the vane and a driving fluid outlet in fluid communication with the vane chamber to discharge the driving fluid after the driving fluid interacts with the vane and rotates the inlet feed component about the central axis. The inlet feed component may include an upper tubular section having a first diameter and a lower tubular section having a second diameter less than the first diameter, and the vane may be positioned around the lower tubular section and sized such that the vane is positioned within an envelope defined by the first diameter projected over a length of the inlet feed component. The drive mechanism may include a pair of bearings and a pair of annular wear rings and the vane may be located between the pair of bearings and between the pair of annular wear rings.

According to another embodiment, the drive mechanism of the fluid jet system may include a ratchet device coupled to the inlet feed component to incrementally rotate the inlet feed component about the central axis. The ratchet device may include, for example, a linear actuator and a catch configured to incrementally rotate the inlet feed component with each actuation of the linear actuator. The ratchet device may further include an annular toothed drive element adapted to move with the inlet feed component, and the catch may be configured to engage a respective tooth of the annular toothed drive element with each actuation of the linear actuator to incrementally rotate the inlet feed component about the central axis. The feed inlet device may include an upper tubular section having a first diameter and a lower tubular section having a second diameter less than the first diameter, and the annular toothed drive element may be positioned around the lower tubular section and sized such that the annular toothed drive element is positioned within an envelope defined by the first diameter projected over a length of the inlet feed component.

According to some embodiments, the jet receiving receptacle further includes a fluid distribution component positioned downstream of the inlet feed component, the fluid distribution component including a central cavity to receive fluid passing through the inlet feed component and a plurality of discharge apertures located about a perimeter of the fluid distribution component in fluid communication with the central cavity to route fluid away from the jet receiving receptacle. The jet receiving receptacle may further include a jet arresting device positioned downstream of the fluid distribution component to assist in dissipating energy of the fluid jet when the fluid jet is discharged by the nozzle into the jet receiving receptacle. The jet receiving receptacle may have a three-stage construction that includes the inlet feed component, the fluid distribution component and the jet arresting device with the fluid distribution component positioned between the inlet feed component and the jet arresting device.

The jet receiving receptacle may be coupled to move in unison with the nozzle by a rigid support arm and the rigid support arm may be shaped to define a workpiece clearance envelope between the nozzle and the jet receiving receptacle. The jet receiving receptacle may be a compact receptacle sized to arrest the fluid jet discharged from the nozzle within the confines of a cylindrical envelop having a diameter of between about two inches and about four inches and a length between about five inches and about seven inches.

In one embodiment, a jet receiving receptacle coupleable to a high pressure fluid jet system opposite a nozzle thereof to receive a fluid jet discharged from the nozzle may be summarized as including: an inlet feed component having a tapered inlet that defines a jet receiving surface about a central axis, the jet receiving surface converging toward the central axis in a downstream direction to receive the fluid jet and direct the fluid jet downstream and toward the central axis; and a drive mechanism adapted to rotate the inlet feed component about the central axis such that impact of the fluid jet with the inlet feed component is distributed continuously or intermittingly around the jet receiving surface defined by the tapered inlet. The drive mechanism may include a vane adapted to continuously rotate the inlet feed component about the central axis in response to a driving fluid or a ratchet device coupled to the inlet feed component to incrementally rotate the inlet feed component. The jet receiving receptacle may have a three-stage construction that includes the inlet feed component, a fluid distribution component and a jet arresting device to assist in dissipating energy of the fluid jet when the fluid jet is discharged by the nozzle into the jet receiving receptacle, the fluid distribution component positioned between the inlet feed component and the jet arresting device along the central axis, the fluid distribution component including a central cavity to receive fluid passing through the inlet feed component and a plurality of discharge apertures located about a perimeter of the fluid distribution component in fluid communication with the central cavity via a cavity of the jet arresting device to route fluid away from the jet receiving receptacle.

According to another embodiment, a jet receiving receptacle coupleable to a high pressure fluid jet system opposite a nozzle thereof to receive a fluid jet discharged from the nozzle may be summarized as including: an inlet feed component having a tapered inlet that defines a jet receiving surface about a central axis, the jet receiving surface converging toward the central axis in a downstream direction to receive the fluid jet and direct the fluid jet downstream and toward the central axis; and a housing having a cavity to receive and rotatable support the inlet feed component such that the fluid jet discharged from the nozzle interacts with the jet receiving surface to impart rotation to the inlet feed component.

According to yet another embodiment, a method of capturing a fluid jet generated by a high pressure fluid jet system may be summarized as causing the fluid jet to impinge directly on a jet receiving surface defined by a tapered inlet of an inlet feed component after the fluid jet acts on the workpiece, the jet receiving surface converging toward a central axis of the tapered inlet in a downstream direction to direct the fluid jet downstream and toward the central axis; and rotating the inlet feed component about the central axis such that impact of the fluid jet with the inlet feed component is distributed continuously or intermittingly around the jet receiving surface defined by the tapered inlet of the inlet feed component. Rotating the inlet feed component may include rotating the inlet feed component intermittently or continuously using a driving fluid, a ratchet device, a electric motor or other suitable drive mechanism.

According to yet another embodiment, a jet receiving receptacle coupleable to a high pressure fluid jet system opposite a nozzle thereof to receive a fluid jet discharged from the nozzle during a workpiece processing operation may be summarized as including: an inlet feed component having a tapered inlet that defines a jet receiving surface about a central axis, the jet receiving surface diverging away from the central axis in a downstream direction to receive the fluid jet and direct the fluid jet downstream; and a drive mechanism adapted to rotate the inlet feed component about the central axis such that impact of the fluid jet with the inlet feed component is distributed continuously or intermittingly around the jet receiving surface defined by the tapered inlet. The jet receiving surface defined by the tapered inlet of the inlet feed component may be frustoconical with a first diameter at an upstream end of the jet receiving surface being smaller than a second diameter at a downstream end of the jet receiving surface.

According to yet another embodiment, a jet receiving receptacle coupleable to a high pressure fluid jet system opposite a nozzle thereof to receive a fluid jet discharged from the nozzle during a workpiece processing operation may be summarized as including: a unitary inlet feed component having an inlet that defines a jet receiving surface about a central axis, at least a portion of the jet receiving surface being cylindrical; a rotationally static fluid distribution component positioned immediately downstream of the unitary inlet feed component, the fluid distribution component including a central cavity to receive fluid passing through the inlet feed component and at least one discharge aperture in fluid communication with the central cavity to route fluid away from the jet receiving receptacle; and a drive mechanism adapted to rotate the inlet feed component about the central axis such that impact of the fluid jet with the inlet feed component is distributed continuously or intermittingly around the jet receiving surface.

According to still yet another embodiment, a jet receiving receptacle coupleable to a high pressure fluid jet system opposite a nozzle thereof to receive a fluid jet discharged from the nozzle during a workpiece processing operation may be summarized as including: an inlet feed component having an inlet that defines a jet receiving surface, the jet receiving surface having an oblong shape at an upstream end thereof; and a drive mechanism adapted to rotate the inlet feed component about a central axis such that impact of the fluid jet with the inlet feed component is coordinated with an angular position of the oblong jet receiving surface relative to the central axis.

DETAILED DESCRIPTION

Figure 1:
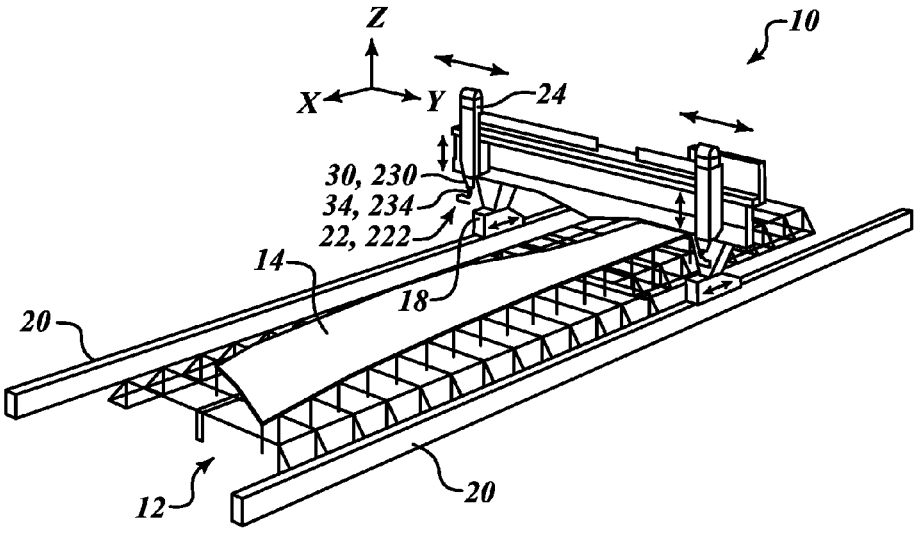
FIG. 1 is an isometric view of a waterjet cutting system, according to one embodiment, having a waterjet cutting head equipped with a fluid jet receptacle having a rotatable inlet feed component.

In the following description, certain specific details are set forth in order to provide a thorough understanding of various disclosed embodiments. However, one of ordinary skill in the relevant art will recognize that embodiments may be practiced without one or more of these specific details. In other instances, well-known structures associated with waterjet cutting systems and methods of operating the same may not be shown or described in detail to avoid unnecessarily obscuring descriptions of the embodiments. For instance, it will be appreciated by those of ordinary skill in the relevant art that a high-pressure fluid source and an abrasive source may be provided to feed high-pressure fluid and abrasives, respectively, to a cutting head of the waterjet systems described herein to facilitate, for example, high-pressure or ultrahigh-pressure abrasive waterjet cutting of workpieces. As another example, well know control systems and drive components may be integrated into the waterjet cutting systems to facilitate movement of the cutting head relative to the workpiece to be processed. These systems may include drive components to manipulate the cutting head about multiple rotational and translational axes, such as, for example, as is common in five-axis abrasive waterjet cutting systems. Example waterjet systems may include waterjet cutting heads coupled to a gantry-type motion system or a robotic arm motion system.

Unless the context requires otherwise, throughout the specification and claims which follow, the word "comprise" and variations thereof, such as, "comprises" and "comprising" are to be construed in an open, inclusive sense, that is as "including, but not limited to."

Reference throughout this specification to "one embodiment" or "an embodiment" means that a particular feature, structure or characteristic described in connection with the embodiment is included in at least one embodiment. Thus, the appearances of the phrases "in one embodiment" or "in an embodiment" in various places throughout this specification are not necessarily all referring to the same embodiment. Furthermore, the particular features, structures, or characteristics may be combined in any suitable manner in one or more embodiments.

As used in this specification and the appended claims, the singular forms "a," "an," and "the" include plural referents unless the content clearly dictates otherwise. It should also be noted that the term "or" is generally employed in its sense including "and/or" unless the content clearly dictates otherwise.

Embodiments described herein provide fluid jet receptacles and waterjet cutting systems incorporating the same and related methods which are particularly well adapted for receiving a jet during workpiece processing and for distributing the jet over a tapered inlet receiving surface to prolong component life and minimize or prevent rebounding of the jet. Embodiments include a jet receiving receptacle having a rotatable inlet feed component which is coupleable to a high pressure fluid jet system opposite a nozzle thereof to receive a fluid jet discharged from the nozzle in a particularly compact form factor or package.

As described herein, the term cutting head may refer generally to an assembly of components at a working end of the waterjet cutting machine or system, and may include, for example, a nozzle of the waterjet cutting system for generating a high-pressure waterjet and surrounding structures and devices coupled directly or indirectly thereto to move in unison therewith. The cutting head may also be referred to as an end effector.

FIG. 1 shows an example embodiment of a waterjet cutting system 10. The waterjet cutting system 10 operates in the vicinity of a support structure 12 which is configured to support a workpiece 14 to be processed by the system 10. The support structure 12 may be a rigid structure or a reconfigurable structure suitable for supporting one or more workpieces 14 (e.g., composite aircraft parts) in a position to be cut, trimmed or otherwise processed. Examples of suitable workpiece support structures 12 include those shown and described in Flow's U.S. application Ser. No. 12/324,719, filed Nov. 26, 2008, and published as US 2009/0140482, which is incorporated herein by reference in its entirety.

The waterjet cutting system 10 further includes a bridge assembly 18 which is movable along a pair of base rails 20 and straddles the support structure 12. In operation, the bridge assembly 18 moves back and forth along the base rails 20 with respect to a translational axis X to position a cutting head 22, 222 of the system 10 for processing the workpiece 14. A tool carriage 24 is movably coupled to the bridge assembly 18 to translate back and forth along another translational axis Y, which is aligned perpendicularly to the translational axis X. The tool carriage 24 is further configured to raise and lower the cutting head 22, 222 along yet another translational axis Z to move the cutting head 22, 222 toward and away from the workpiece 14. A manipulable forearm 30, 230 and wrist 34, 234 are provided intermediate the cutting head 22, 222 and the tool carriage 24 to provide additional functionally.

Figure 2:
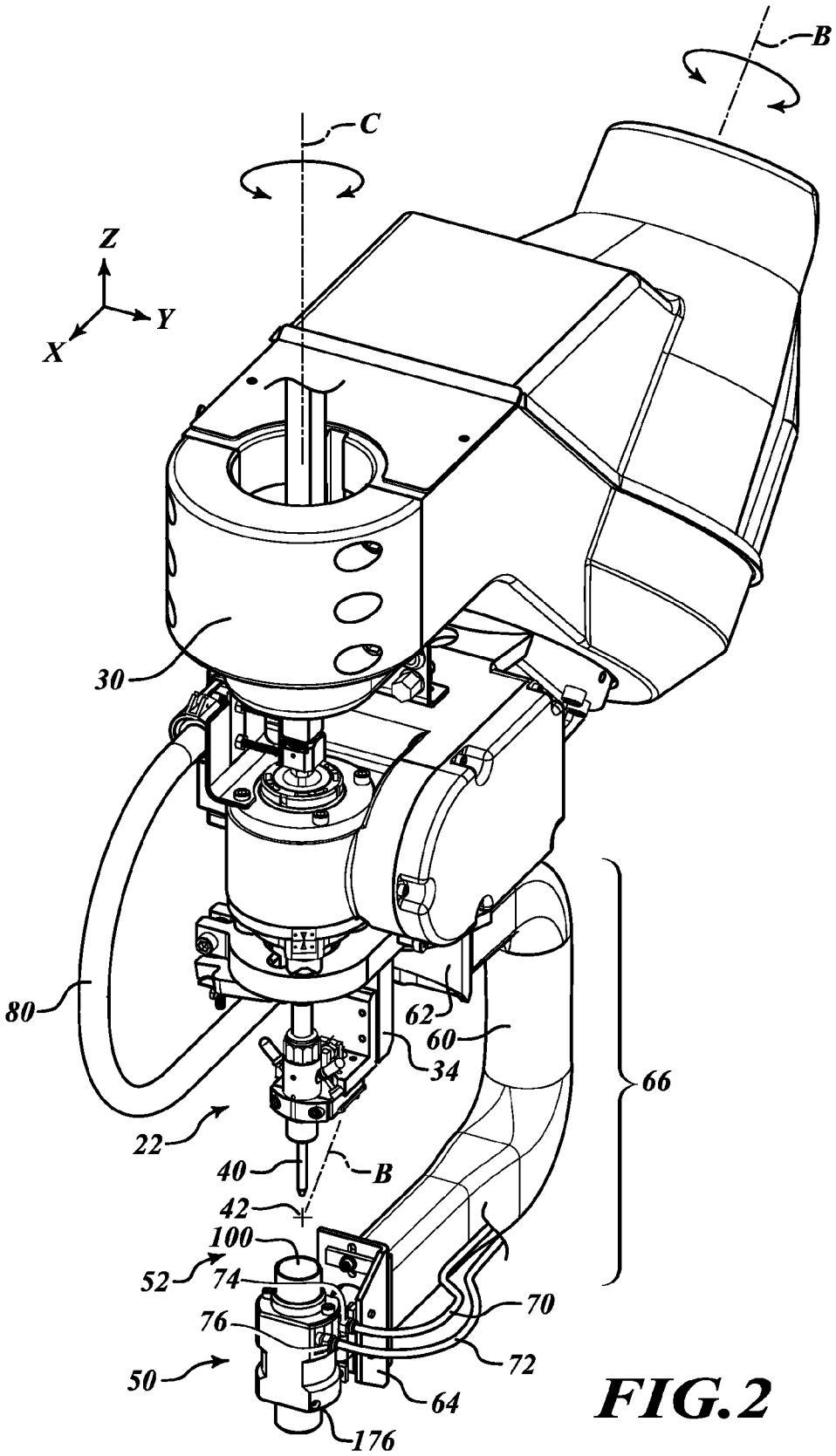
FIG. 2 is an isometric view of a fluid jet receptacle having a rotatable inlet feed component, according to one embodiment, coupled to and positioned opposite a waterjet cutting head of the waterjet cutting system of FIG. 1.
Figure 6:
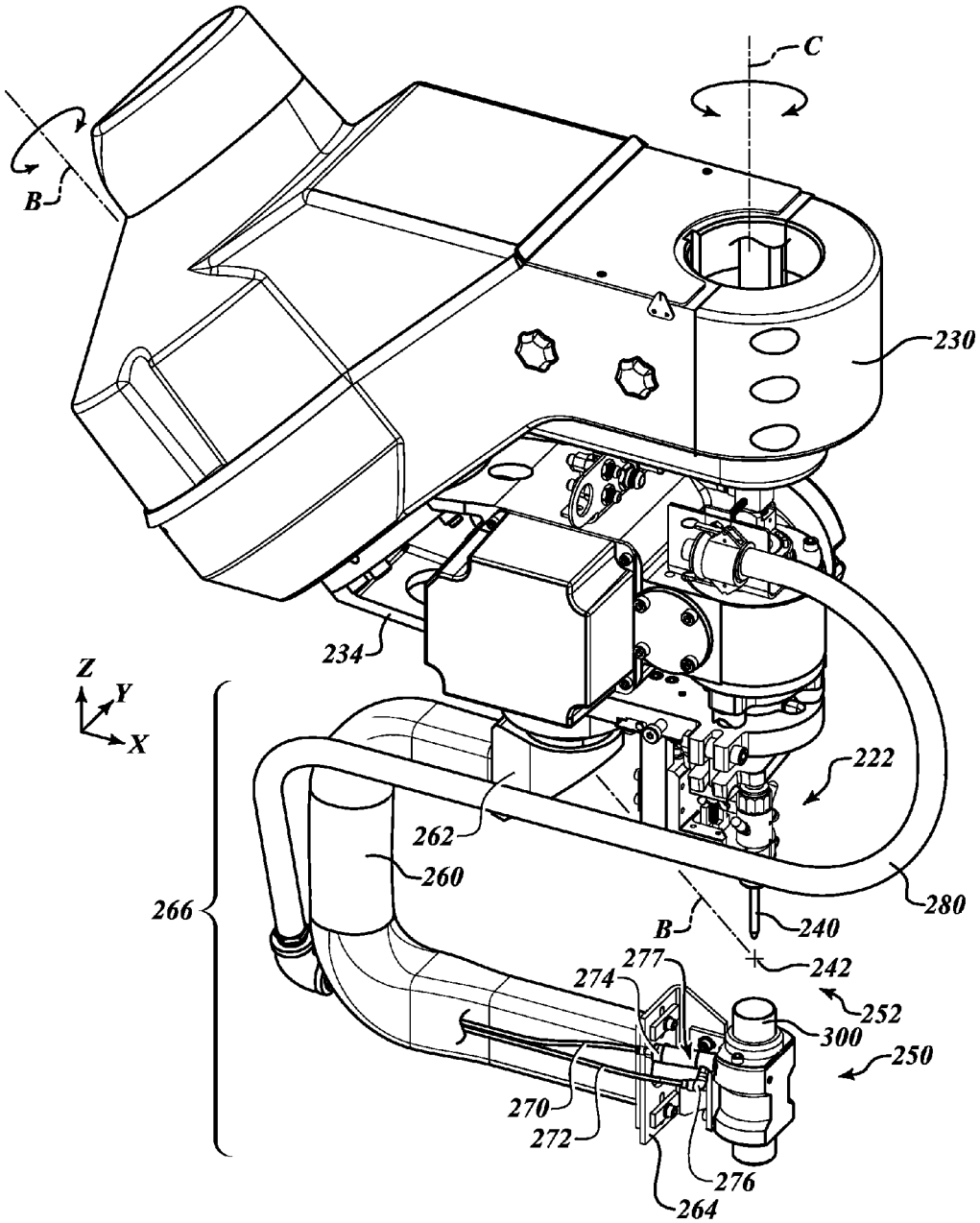
FIG. 6 is an isometric view of a fluid jet receptacle having a rotatable inlet feed component, according to another embodiment, coupled to and positioned opposite a waterjet cutting head of the waterjet cutting system of FIG. 1.

More particularly, with reference to FIGS. 2 and 6, a forearm 30, 230 of the system 10 may be rotatably coupled to the tool carriage 24 for rotate the cutting head 22, 222 about an axis of rotation C. In addition, a wrist 34, 234 of the system 10 may be rotatably coupled to the forearm 30, 230 to rotate the cutting head 22, 222 about another axis of rotation B that is non-parallel to the aforementioned rotational axis C. In combination, the rotational axes B, C enable the cutting head 22, 222 to be manipulated in a wide range of orientations relative to the workpiece 14 to facilitate, for example, cutting of complex profiles. The rotational axes B, C may converge at a focal point 42, 242 which, in some embodiments, may be offset from the end or tip of a nozzle 40, 240. The end or tip of the nozzle 40, 240 of the cutting head 22, 222 is preferably positioned at a desired standoff distance from the workpiece 14 to be processed. The standoff distance may be selected or maintained at a desired distance to optimize the cutting performance of the waterjet.

During operation, movement of the cutting head 22, 222 with respect to each of the translational axes X, Y, Z and rotational axes B, C may be accomplished by various conventional drive components and an appropriate control system (not shown). Other well know systems associated with waterjet cutting systems may also be provided such as, for example, a high-pressure or ultrahigh-pressure fluid source (e.g., direct drive and intensifier pumps with pressure ratings ranging from 40,000 psi to 100,000 psi and higher) for supplying high-pressure or ultrahigh-pressure fluid to the cutting head 22, 222 and/or an abrasive source (e.g., abrasive hopper and distribution system) for feeding abrasives to the cutting head 22, 222 to enable abrasive waterjet cutting. In some embodiments, a vacuum device may be provided to assist in drawing abrasives into the fluid from the fluid source to produce a consistent abrasive fluid jet to enable particularly accurate and efficient workpiece processing. Details of the control system, conventional drive components and other well known systems associated with waterjet cutting systems, however, are not shown or described in detail to avoid unnecessarily obscuring descriptions of the embodiments.

Furthermore, although the example waterjet cutting system 10 of FIG. 1 is illustrated as including a bridge assembly 18 or gantry-type motion system, it will be appreciated that embodiments of the fluid jet receiving receptacle devices described herein may be used in connection with many different known motion systems, including, for example, robotic arms which may be manipulated about numerous rotational and/or translational axis to position a cutting head and an associated fluid jet receptacle in a wide range of positions and orientations. Still further, in some instances, the waterjet cutting systems may feature a stationary cutting head wherein a workpiece is manipulated beneath a nozzle thereof and wherein a fluid jet receptacle device is mounted opposite the nozzle.

With reference to FIG. 2, the nozzle 40 may protrude from a working end of the cutting head 22. As is typical of conventional waterjet cutting systems, the nozzle 40 may include an orifice (not shown), such as a jewel orifice, through which fluid passes during operation to generate a fluid jet for processing a workpiece 14. A fluid jet receiving receptacle 50 having a rotatable inlet feed component 100, according to one example embodiment, is coupled to the cutting head 22 to move in unison therewith during cutting or other processing operations. The jet receiving receptacle 50 is held offset from an end of the nozzle 40 to provide a clearance envelope 52 to receive a workpiece 14 between the nozzle 40 and the jet receiving receptacle 50. In some embodiments, for example, the jet receiving receptacle 50 may be held by a rigid u-shaped support arm 60 in which a proximal end 62 of the arm 60 is attached to the wrist 34 near the cutting head 22 and a distal end 64 of the arm 60 is attached to the jet receiving receptacle 50. The distal end 64 of the arm 60 may be attached to the jet receiving receptacle 50, for example, by fasteners engaging threaded holes 84 (FIG. 3) on a mounting face 86 (FIG. 3) of the receptacle 50. In some embodiments, the distal end 64 of the arm 60 may be adjustably attached to the jet receiving receptacle 50 to enable widening or narrowing of the workpiece clearance envelope 52. The cutting head 22, support arm 60 and jet receiving receptacle 50 may define a generally rigid cutting head assembly 66 during operation.

In other embodiments, one or more drive components may be coupled between the distal end 64 of the support arm 60 and the receptacle 50 to manipulate the orientation of the jet receiving receptacle 50 during operation. In such embodiments, the orientation of the jet receiving receptacle 50 may be coordinated with the velocity and/or trajectory of the cutting head nozzle 40 during operation to optimize or otherwise manipulate contact of the discharged jet with the jet receiving receptacle 50. For example, relatively higher cutting speeds may result in greater jet deflection from a central axis of the nozzle 40 and the jet receiving receptacle 50 may be controlled to tilt to a greater degree in such instances to receive the deflected jet in a more coaxial manner. In addition, in some embodiments, the receptacle 50 may be oriented such that the jet impacts a surface of the rotatable inlet feed component 100 and imparts a rotational motion to the same. For example, inlet feed component 100 may be tilted such that a component of the incoming jet acts in a direction of the desired rotation.

Conveniently, the arm 60 may also facilitate routing of various conduits or other devices for enabling certain functionality of the jet receiving receptacle 50 described herein. For example, working or driving fluid conduits 70, 72 may be routed within or along the arm 60 to respective fittings or adapters 74, 76 on the jet receiving receptacle 50 to route working fluid to and from the jet receiving receptacle 50. As another example, a discharge or suction conduit 80 may be provided along or within the arm 60 to couple with the jet receiving receptacle 50 and assist in removing fluid and abrasives (when present) from the discharged jet that is caught by the jet receiving receptacle 50 during operation, as described in more detail elsewhere.

Figure 3:
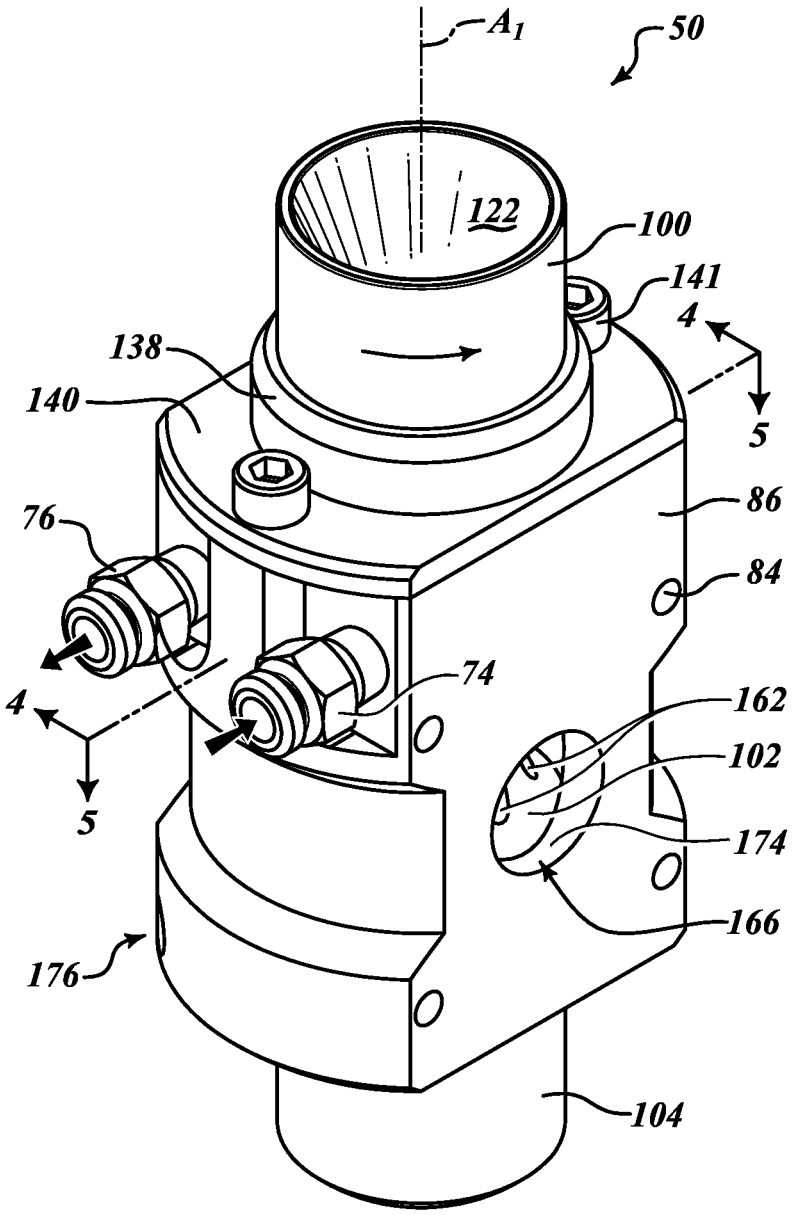
FIG. 3 is an isometric view of the fluid jet receptacle of FIG. 2 isolated from the waterjet cutting system of FIG. 1.
Figure 4:
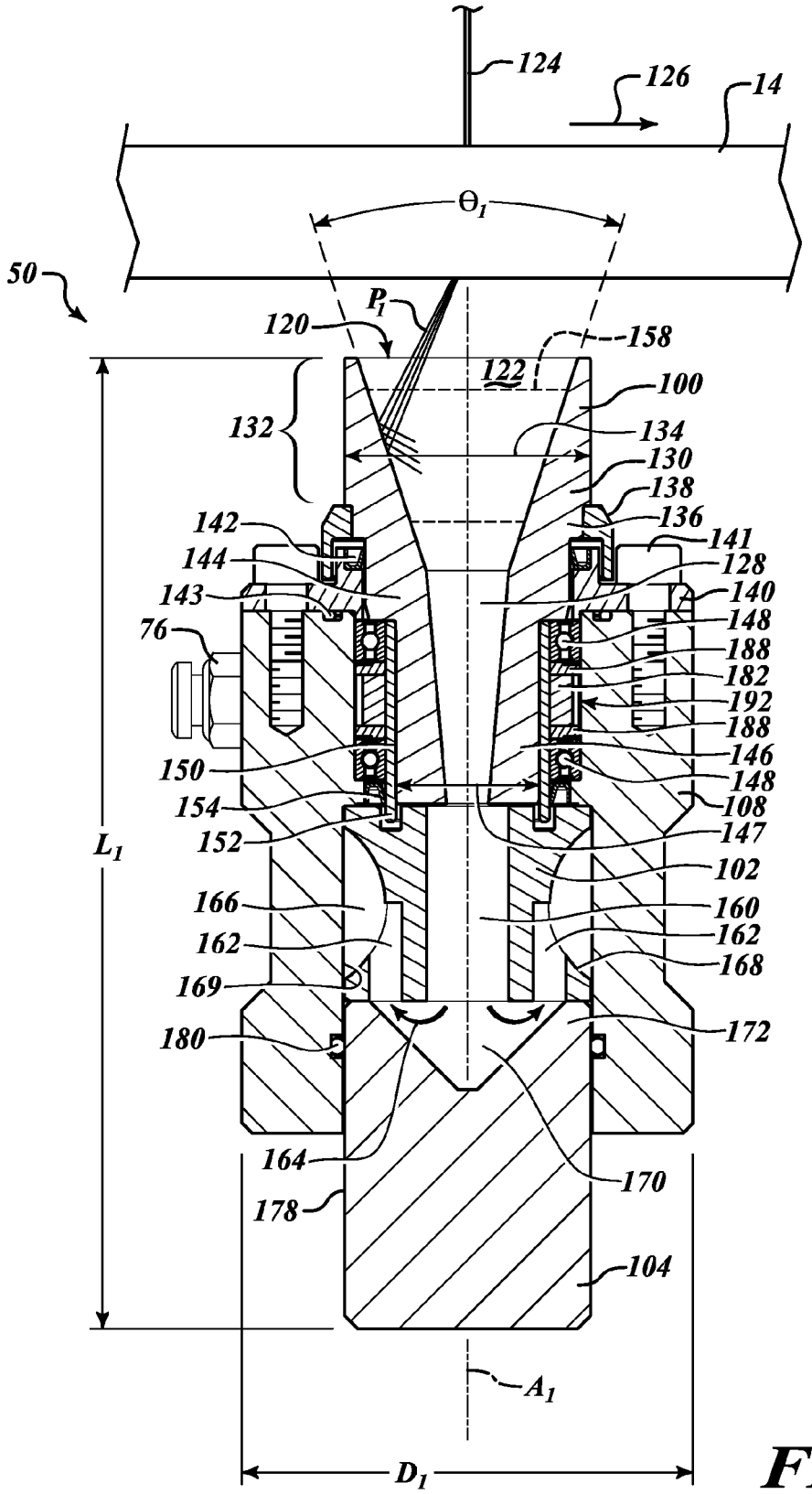
FIG. 4 is a cross-sectional view of the fluid jet receptacle of FIG. 3 taken along line 4-4 with an example workpiece positioned above the receptacle.
Figure 5:
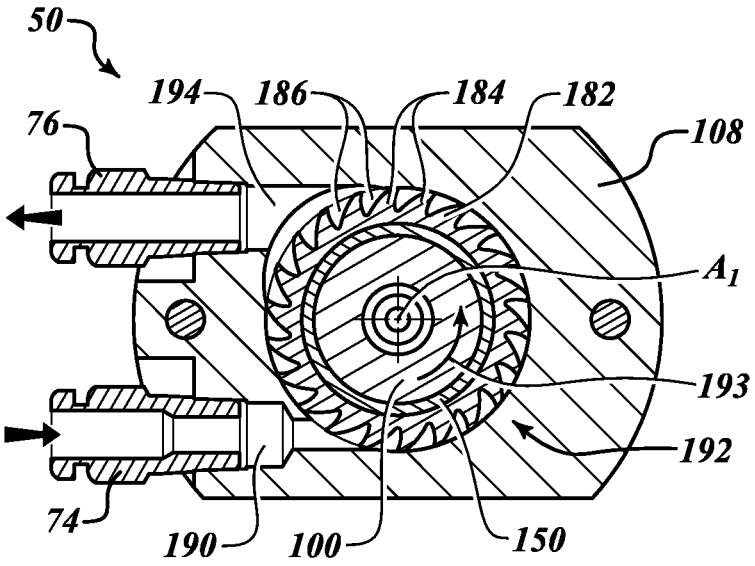
FIG. 5 is a cross-sectional view of the fluid jet receptacle of FIG. 3 taken along line 5-5.

Further details of the jet receiving receptacle 50 will now be provided with reference to FIGS. 3 through 5. As shown best in FIG. 4, the jet receiving receptacle 50 may have a three-stage construction that includes an inlet feed component 100, a fluid distribution component 102 and a jet arresting device 104; although more or fewer stages may be provided in other embodiments. For example, in some embodiments the fluid distribution component 102 and the jet arresting device 104 may be combined in a single unitary component to provide the same or similar functionalities of these otherwise separate components. In one particularly advantageous embodiment, the inlet feed component 100, fluid distribution component 102 and jet arresting device 104 are retained at least partially within a housing 108 and arranged in a linear fashion along a central axis $A_1$ with the fluid distribution component 102 positioned between the inlet feed component 100 and the jet arresting device 104, as shown in FIG. 4.

The example inlet feed component 100 includes a tapered inlet 120 that defines a jet receiving surface 122 about the central axis $A_1$ and converging toward the same in a downstream direction (i.e., the direction in which fluid of a fluid jet 124 passes through the inlet feed component 100 during operation). The jet receiving surface 122 may be frustoconical or have a cross-sectional profile that is curvilinear, including convex and/or concave profiles. In some embodiments, the tapered inlet 120 and hence jet receiving surface 122 may be frustoconical and have an included angle $\theta_1$ that measures between about twenty degrees and about seventy degrees, and in other embodiments, between about 30 degrees and about 45 degrees. The tapered inlet 120 and hence jet receiving surface 122 may extend partially or entirely through a longitudinal length of the inlet feed component 100. In embodiments in which the jet receiving surface 122 extends only partially through the inlet feed component 100, a supplemental passage 128 may be provided in fluid communication with the tapered inlet 120 to enable fluid and abrasives (when present) of the jet 124 to pass completely through the inlet feed component 100 in the downstream direction. The supplemental passage 128 may be tapered, as shown in FIG. 4, generally cylindrical, or of a different shape or form.

A body 130 of the inlet feed component 100 in which the tapered inlet 120 is provided may be generally cylindrical or include generally cylindrical sections over a longitudinal length of the inlet feed component 100, as shown in FIG. 4. For instance, in some embodiments, an upstream section 132 of the body 130 may be generally cylindrical. An outer surface of the upstream section 132 may have an outer diameter 134 between about one inch and about two and one-half inches. In addition, the outer diameter 134 of the upstream section 132 may be between about forty percent and about sixty percent of an outer diameter $D_1$ of the jet receiving receptacle 50 defined by a portion of the housing 108. In this manner, the receptacle 50 may remain relatively compact to minimize interference with the workpiece 14 or support structure 12 during operation while also providing a tapered inlet 120 of sufficient size to effectively capture the jet 124 under normal operating conditions of high-pressure and ultra-high pressure fluid jet cutting systems.

Other portions or sections of the body 130 of the inlet feed component 100 may be stepped or otherwise shaped to facilitate mounting of the inlet feed component 100 in a supporting device, such as, for example, the housing 108 of the embodiment shown in FIGS. 2 through 5. For example, as shown in FIG. 4, the body 130 may include a stepped section 136 for receiving a collar element 138 which may be used in connection with a cover member 140 to capture a seal element 142 adjacent the inlet feed component 100, which may be used to prevent fluid from escaping from the receptacle 50 between the inlet feed component 100 and the cover member 140 during operation. As another example, the body 130 may include another stepped section 144 sized to pass through an aperture in the cover member 140 and to engage the seal element 142.

Still further, the body 130 may have yet another stepped section 146 having a diameter 147 sized to receive one or more bearings 148, such as, for example, plain bearings or roller element bearings, including ball bearings, to assist in rotatably supporting the inlet feed component 100 about the central axis $A_1$. In some embodiments, a sleeve 150 may be positioned between the stepped section 146 of the body 130 and the one or more bearings 148. In such embodiments, a portion 152 of the sleeve 150 may extend beyond a terminal end of the body 130 of the inlet feed component 100 to be received by and align with the fluid distribution component 102. The sleeve 150 may cooperate with the housing 108 and/or other components to retain another seal element 154 between the housing 108 and a lower or downstream end of the inlet feed component 100 to assist in preventing fluid from escaping between the housing 108 and the inlet feed component 100 during operation.

Irrespective of the particular external profile of the inlet feed component 100, the interior profile includes the downstream-converging, tapered jet receiving surface 122 at an upper end thereof to be positioned near the location of where the jet 124 exits the workpiece 14 being processed. In some embodiments, the receptacle 50 is configured such that the jet receiving surface 122 is positioned immediately downstream of a workpiece 14 without any intervening structures, and in particular static structures.

As can be appreciated from FIG. 4, the jet 124 may deflect substantially from an initial trajectory as it passes through the workpiece 14, with the amount of deflection varying based on a variety of factors including, for example, cutting speed, material type and material thickness. The jet 124 may deflect, for example, from a generally vertical initial trajectory to the path $P_1$ shown in FIG. 4 when cutting a workpiece 14 while moving the cutting head 22 in the direction indicated by the arrow labeled 126 or it may deflect to a greater or lesser degree than that of the path $P_1$ shown. Accordingly, the jet 124 may impinge on the jet receiving surface 122 at different locations along a cross-sectional profile of the tapered inlet 120.

In operation, the inlet feed component 100 is driven to rotate continuously or intermittently about the central axis $A_1$ such that the impact of the jet 124 with the inlet feed component 100 of the jet receiving receptacle 50 is distributed continuously or intermittingly around the jet receiving surface 122 defined by the tapered inlet 120. In this manner, the jet 124 is directed to wear upon the jet receiving surface 122 over a tapered annular area such as, for example, the wear area 158 bound by the phantom lines shown in FIG. 4. Distributing the impact of the jet 124 over this relatively large wear area 158 advantageously prolongs the life of the inlet feed component 100 and reduces premature surface defects or irregularities (e.g., pits or pockets) that may cause fluid and abrasives (when present) to rebound out of the receptacle 50. In some embodiments, the wear area 158 may be at least one-half of a square inch, and in other embodiments, may be at least two square inches. In still yet other embodiments, the wear area 158 may be at least four square inches.

The inlet feed component 100 may be controlled to rotate continuously throughout a portion or an entirety of a cutting operation. Alternatively, the inlet feed component 100 may be controlled to rotate intermittently throughout a portion or an entirety of a cutting operation or rotate intermittently at times in between cutting or other processing operations or at regular or irregular intervals. For example, the inlet feed component may be clocked 5, 10, 15 or 20 degrees between each of a series of processing operations or clocked 5, 10, 15 or 20 degrees after a given duration throughout a work day or shift. Irrespective of the particular control scheme, the inlet feed component 100 is rotatably driven to present a relatively large area of the jet receiving surface 122 for impingement by the jet 124 to distribute wear more evenly and prolong component life.

As previously described, the inlet feed component 100 may be positioned upstream of and, in some instances, in a linear relationship with a fluid distribution component 102, as shown best in FIG. 4. The fluid distribution component 102 may include a central cavity 160 to receive fluid passing through the inlet feed component 100 and a plurality of discharge apertures 162 located about a perimeter of the fluid distribution component 102. The discharge apertures 162 are in fluid communication with the central cavity 160, as indicated by the arrows labeled 164, to route fluid away from the jet receiving receptacle 50 during operation. The discharge apertures 162 may be configured to route fluid and abrasives (when present) to an outlet chamber 166 formed between an exterior surface 168 of the fluid distribution component 102 and an interior surface 169 of the housing 108.

The discharge apertures 162 may be in fluid communication with the central cavity 160 via a cavity 170 formed in an upper end 172 of jet arresting device 104 positioned downstream of the fluid distribution component 102. The cavity 170 may be shaped to direct incoming fluid and abrasives (when present) radially outward and back upstream through the discharge apertures 162 in the periphery of the fluid distribution component 102 to the outlet chamber 166. From the outlet chamber 166, fluid may be drawn out of the receptacle 50 by a vacuum device coupled to an outlet 174 (FIG. 3) of the receptacle via a discharge conduit 80 (FIG. 2). The discharged fluid and abrasives that may be recovered by the jet receiving receptacle 50 can be reconditioned for reuse in the waterjet cutting system 10 (FIG. 1).

The fluid distribution component 102 and the jet arresting device 104 may be generally cylindrical components which are insertable in an upstream direction in a common bore or cavity of the housing 108. The fluid distribution component 102 may be held in place in the housing 108 by the jet arresting device 104 and the jet arresting device 104 may be secured in place by a set screw 176 located within the housing 108 to engage the exterior surface 178 of the jet arresting device 104 or with other fasteners or securing mechanisms. Advantageously, the jet arresting device 104 and the fluid distribution component 102 may be readily removed from the housing 108 for periodic inspection and/or replacement. Another seal element 180, such as, for example, an o-ring, may be positioned between the housing 108 and the jet arresting device 104 to assist in preventing fluid from escaping between the housing 108 and the jet arresting device 104.

Although the jet arresting device 104 is shown as a unitary member which may be formed of or act as a sacrificial material to arrest the incoming jet 124, in other embodiments, the jet arresting device 104 may be provided in other forms and include known mechanisms for dissipating the energy of a high pressure fluid jet, such as, for example, a collection of balls, particles or other elements that absorb energy of the incoming jet 124 when interacting with the same.

Collectively, the inlet feed component 100, the fluid distribution component 102 and the jet arresting device 104 are particularly effective in forming a jet receiving receptacle 50 to capture a high pressure fluid jet or abrasive fluid jet in a compact form factor with exceptional durability. For instance, in some embodiments, a jet receiving receptacle 50 and sub-components thereof are sized to arrest the fluid jet 124 discharged from the nozzle 40 within the confines of a cylindrical envelop having a diameter of between about two inches and about four inches and a length between about five inches and about seven inches. In one particular embodiment, for example, the receptacle 50 has an overall length $L_1$ of about six inches and does not exceed a diameter $D_1$ of about three inches.

As previously described, the inlet feed component 100 is driven to rotate continuously or intermittently about the central axis $A_1$ such that the impact of the jet 124 with the inlet feed component 100 is distributed continuously or intermittingly around the jet receiving surface 122 defined by the tapered inlet 120. Accordingly, in some embodiments, a waterjet cutting system incorporating embodiments of the jet receiving receptacle 50 are provided which include a drive mechanism to rotate the inlet feed component about the central axis $A_1$. The drive mechanism may include, for example, hydraulic systems, pneumatic systems, electric drive motors and other drive components.

With reference to FIGS. 4 and 5, and in accordance with one particularly advantageous embodiment, the drive mechanism may include or interact with a vane 182 that is adapted to rotate the inlet feed component 100 about the central axis $A_1$ in response to a driving fluid. In such embodiments, the vane 182 may be securely coupled to the inlet feed component 100 to move in unison therewith, or alternatively, may be formed integrally therewith. The vane 182 includes a plurality of teeth 184 or other projections with interstitial gaps 186 to receive the driving fluid and to rotate the vane 182 in response to the same with the aid of the bearings 148. More particularly, with reference to FIG. 5, the driving fluid (e.g., compressed air) may be introduced through a supply conduit 70 (FIG. 2) into a corresponding inlet fitting or adapter 76 secured within an inlet 190 of the housing 108 which leads to a vane chamber 192 between the housing 108 and inlet feed component 100 where the vane 182 is provided. After entering the vane chamber 192, the driving fluid interacts with the vane 182 by applying a driving force to the teeth 184 or projections thereof to rotate the vane 182 and hence inlet feed component 100 about the central axis $A_1$. The vane 182 is thus caused to rotate continuously in the direction indicated by the arrow labeled 193 in FIG. 5. The driving fluid is then released through an outlet fitting or adaptor 76 secured within outlet 194 and vented to the environment or routed elsewhere through a discharge conduit 72 (FIG. 2). As will be appreciated by those of ordinary skill in the relevant art, the speed of rotation may be adjusted by varying the flow rate or other characteristics of the driving fluid with appropriate valves and controls (not shown).

In some embodiments, the vane 182 may be positioned in the vane chamber 192 between opposing annular wear rings 188, as shown in FIG. 4, to assist in preventing premature wear or binding of the vane 182 during operation. The vane 182 may also be positioned between the opposing bearings 148 which assist in rotatably supporting the inlet feed component 100.

In some embodiments, the vane 182 may be secured to or otherwise formed integrally with a reduced diameter section 146 of the inlet feed component 100 and sized such that the vane 182 is positioned within an envelope defined by a diameter 134 of the upper or upstream section 132 of the inlet feed component 100 projected over a length thereof. In this manner, the vane 182 and associated drive mechanism can be implemented without greatly affecting the overall working envelope of the jet receiving receptacle 50. This is particularly advantageous in that it enables the receptacle to maintain a relatively compact form factor that can be manipulated about workpieces having complex profiles, for example, without interference.

FIGS. 6 through 9 illustrate another example embodiment of a jet receiving receptacle 250 having a rotatable inlet feed component 300 which is configured to couple to and be positioned opposite a waterjet cutting head 222 of the waterjet cutting system 10 of FIG. 1.

With reference to FIG. 6, and similar to the previously described embodiments, the fluid jet receiving receptacle 250 may be coupled to the cutting head 222 to move in unison therewith during cutting or other processing operations. The jet receiving receptacle 250 is held offset from an end of a nozzle 240 of the cutting head 222 to provide a clearance envelope 252 to receive a workpiece 14 between the nozzle 240 and the jet receiving receptacle 250. The jet receiving receptacle 250 may be held, for example, by a rigid u-shaped support arm 260 in which a proximal end 262 of the arm 260 is attached to a wrist 234 of the cutting system 10 (FIG. 1) near the cutting head 22 and a distal end 264 of the arm 260 is attached to the jet receiving receptacle 250. The distal end 264 of the arm 260 may be attached to the jet receiving receptacle 250, for example, by fasteners engaging threaded holes 284 (FIG. 7) on a mounting face 286 (FIG. 7) of the receptacle 250. In some embodiments, the distal end 264 of the arm 260 may be adjustably attached to the jet receiving receptacle 250 to enable widening or narrowing of the workpiece clearance envelope 252. The cutting head 222, support arm 260 and jet receiving receptacle 250 may operate as a generally rigid cutting head assembly 266 during operation.

In other embodiments, one or more drive components may be coupled between the distal end 264 of the support arm 260 and the receptacle 250 to manipulate the orientation of the jet receiving receptacle 250 during operation. In such embodiments, the orientation of the jet receiving receptacle 250 may be coordinated with the velocity and trajectory of the cutting head nozzle 240 during operation to optimize or otherwise manipulate contact of the discharged jet with the jet receiving receptacle 250. For example, relatively higher cutting speeds may result in greater jet deflection from a central axis of the nozzle 240 and the jet receiving receptacle 250 may be controlled to tilt to a greater degree in such instances to receive the deflected jet in a more coaxial manner. In addition, in some embodiments, the receptacle 250 may be oriented such that the jet impacts a surface of the rotatable inlet feed component 300 and imparts a rotational motion to the same. For example, inlet feed component 300 may be tilted such that a component of the incoming jet acts in a direction of the desired rotation.

Conveniently, the arm 260 may also facilitate routing of various conduits or other devices for enabling the functionality of the jet receiving receptacle 250 described herein. For example, working or driving fluid conduits 270, 272 may be routed within or along the arm 260 to respective fittings or adapters 274, 276 of a ratchet device 277 coupled to the jet receiving receptacle 250 to route working or driving fluid to and from the ratchet device 277. As another example, a discharge or suction conduit 280 may be provided along or within the arm 260 to couple with the jet receiving receptacle 250 and assist in removing fluid and abrasives from the jet that is caught by the jet receiving receptacle 250 during operation, as described in more detail below.

Figure 7:
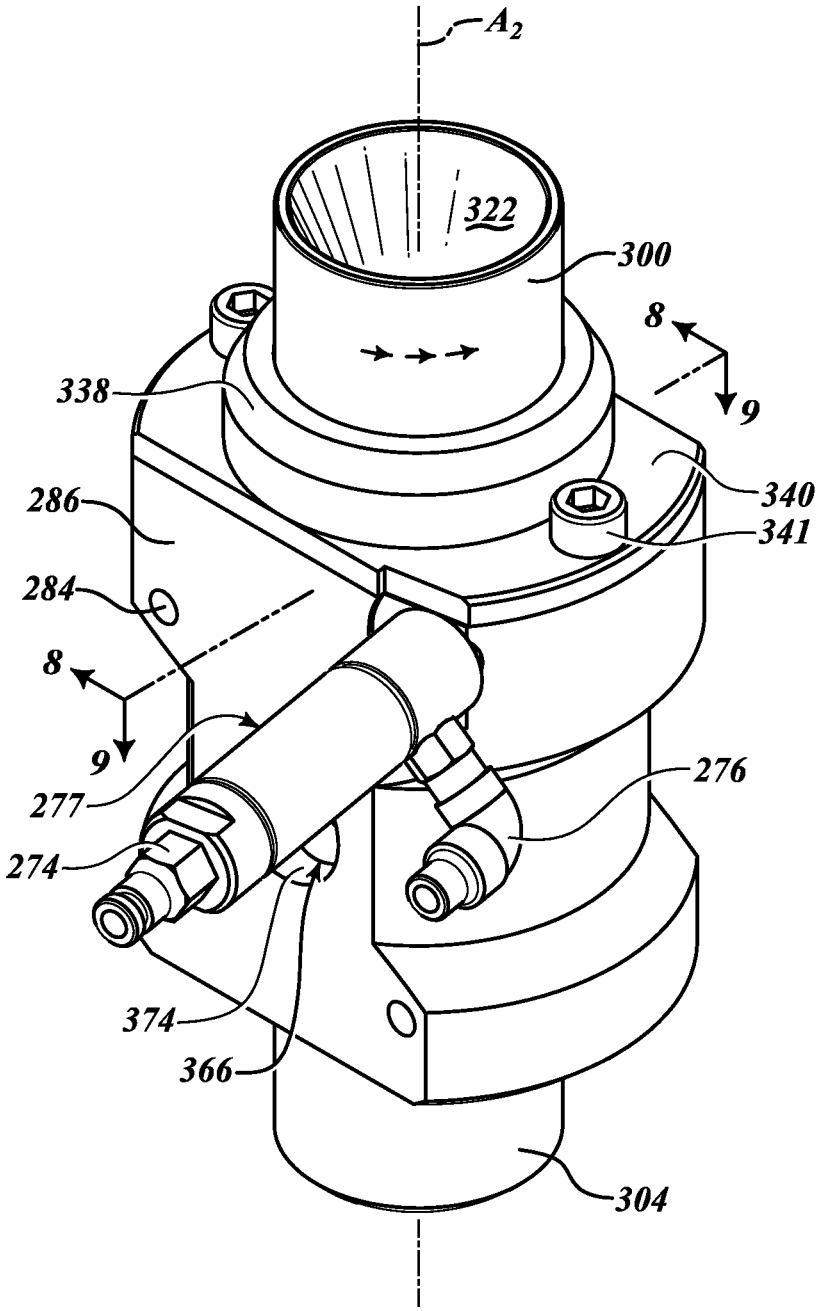
FIG. 7 is an isometric view of the fluid jet receptacle of FIG. 6 isolated from the waterjet cutting system of FIG. 1.
Figure 8:
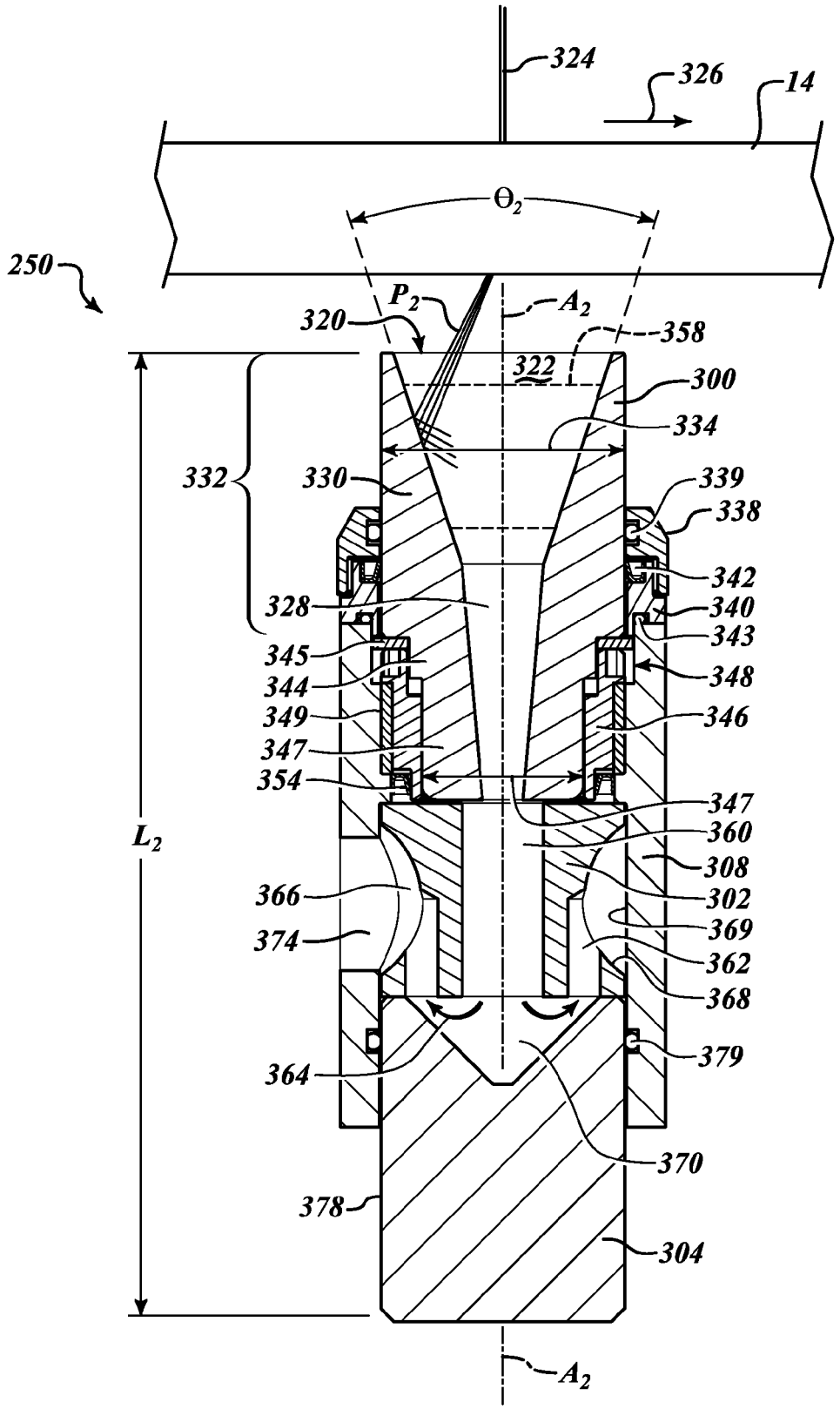
FIG. 8 is a cross-sectional view of the fluid jet receptacle of FIG. 7 taken along line 8-8 with an example workpiece positioned above the receptacle.
Figure 9:
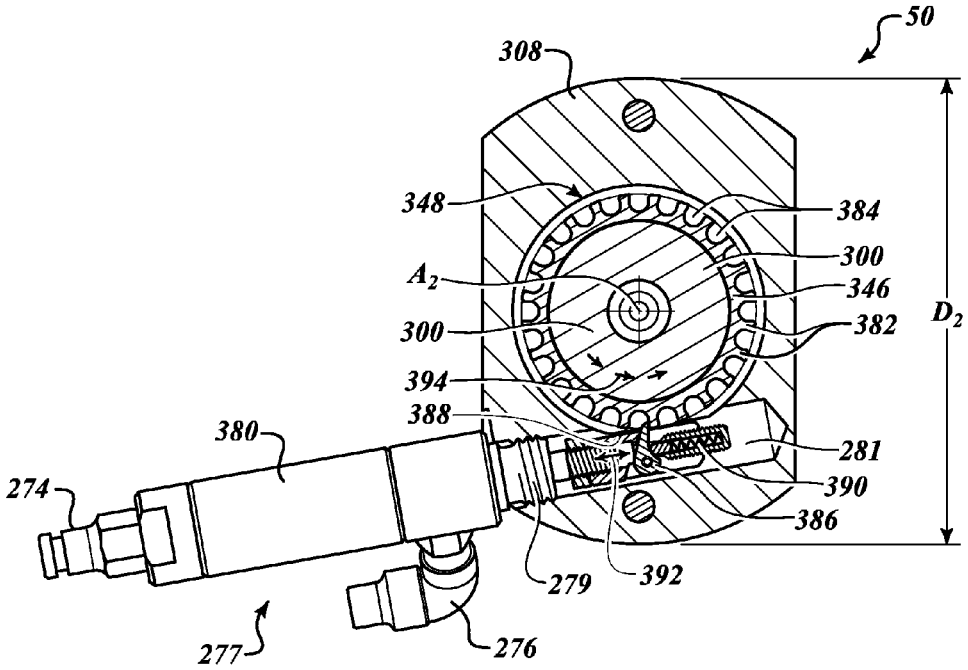
FIG. 9 is cross-sectional view of the fluid jet receptacle of FIG. 7 taken along line 9-9.

Further details of the jet receiving receptacle 250 will now be provided with reference to FIGS. 7 through 9. As shown best in FIG. 8, and similar to other described embodiments, the jet receiving receptacle 250 may have a three-stage construction that includes an inlet feed component 300, a fluid distribution component 302 and a jet arresting device 304, although more or fewer stages may be provided in other embodiments. For instance, in some embodiments, the fluid distribution component 302 and the jet arresting device 304 may be combined in a single unitary component to provide the same or similar functionalities of the otherwise separate components. In one particularly advantageous embodiment, the inlet feed component 300, fluid distribution component 302 and jet arresting device 304 are retained at least partially within a housing 308 and arranged in a linear fashion along a central axis $A_2$ with the fluid distribution component 302 positioned between the inlet feed component 300 and the jet arresting device 304, as shown in FIG. 8.

The example inlet feed component 300 includes a tapered inlet 320 that defines a jet receiving surface 322 about a central axis $A_2$ which converges toward the central axis $A_2$ in a downstream direction (i.e., the direction in which fluid of the fluid jet 324 passes through the inlet feed component 300 during operation). The jet receiving surface 322 may be frustoconical or include a cross-sectional profile that is curvilinear, including convex and/or concave segments. In some embodiments, the tapered inlet 320 and hence jet receiving surface 322 may be frustoconical and have an included angle $8_2$ that measures between about twenty degrees and about seventy degrees, and in other embodiments, between about 30 degrees and about 45 degrees.

The tapered inlet 320 and hence jet receiving surface 322 may extend partially or entirely through a longitudinal length of the inlet feed component 300. In embodiments in which the jet receiving surface 322 extends only partially through the inlet feed component 300, a supplemental passage 328 may be provided in fluid communication with the tapered inlet 320 to enable fluid and abrasives (when present) of the jet 324 to pass completely through the inlet feed component 300 in the downstream direction. The supplemental passage 328 may be tapered, as shown in FIG. 8, generally cylindrical, or of a different shape or form.

A body 330 of the inlet feed component 300 in which the tapered inlet 320 is provided may be generally cylindrical or include generally cylindrical sections over a longitudinal length of the inlet feed component 300, as shown in FIG. 8. For instance, in some embodiments, an upstream end 332 of the body 330 may be generally cylindrical. In some embodiments, an outer surface of the upstream end 332 may have an outer diameter 334 between about one inch and about two and one-half inches. In addition, the outer diameter 334 of the upstream end 332 may be between about forty percent and about sixty percent of an outer diameter $D_2$ (FIG. 9) of the jet receiving receptacle 250 defined by a portion of the housing 308. In this manner, the receptacle 250 remains relatively compact to minimize interference with the workpiece 14 or support structure 12 during operation while also providing a tapered inlet 320 of sufficient size to effectively capture the jet 324 under normal operating conditions of high-pressure and ultrahigh pressure fluid jet cutting systems.

With continued reference to FIG. 8, a collar element 338 may be provided around the periphery of the upper or upstream end 332 of the inlet feed component 300 with a seal element 339, such as an o-ring seal, positioned therebetween to assist in preventing fluid from escaping between the inlet feed component 300 and the collar element 338. The collar element 338 may be used in connection with a cover member 340 to capture another seal element 342 adjacent the inlet feed component 300 to assist in preventing fluid from escaping from the receptacle 250 between the inlet feed component 300 and the cover member 340 during operation. The cover member 340 may be secured to the housing by fasteners 341 (FIG. 7) or other devices with yet another seal element 343, such as an o-ring, positioned between the cover member 340 and the housing 308.

Other sections of the body 330 of the inlet feed component 300 may be stepped or otherwise shaped to facilitate mounting or assembly of the inlet feed component 300 within a supporting device, such as, for example, the housing 308 of the embodiment shown in FIGS. 6 through 9. For example, with reference to FIG. 8, the body 330 may include a stepped section 344 having a diameter sized to receive an annular wear ring 345 and at least a portion of a drive element 346 between the housing 308 and the stepped section 344. The wear ring 345 may be positioned between a shoulder of the inlet feed component 300 and the drive element 346 and may be sized to protrude beyond a outer periphery of the drive element 346 to engage a sidewall of the housing 308 during operation to assist in rotatably supporting the inlet feed component 300.

The drive element 346 may be fixedly attached to the inlet feed component 300 to rotate in unison therewith, such as, for example, by using a set screw (not shown) or other fastening device to fix the drive element 346 to the inlet feed component 300. In other embodiments, the drive element 346 may be press fit onto the inlet feed component 300 and secured thereto without the use of fasteners. In still other embodiments, the drive element 346 may be formed integrally with the inlet feed component 300. The drive element 346 may surround the stepped section 344 and another stepped section 347 downstream thereof within a drive element cavity 348 formed between the inlet feed component 300 and the housing 308, as shown in FIG. 8.

One or more bearings 349, such as, for example, plain bearings or roller element bearings, including ball bearings, may be provided between the body 330 of the inlet feed component 300 and the housing 308 to assist in rotatably supporting the inlet feed component 300 about the central axis $A_2$. A lower portion of the drive element 346 may cooperate with the housing 308 and/or other components to retain another seal element 354 between the housing 308 and a lower or downstream end of the inlet feed component 300 to assist in preventing fluid from escaping between the housing 308 and the inlet feed component 300 during operation.

Irrespective of the particular external profile of the inlet feed component 300, the interior profile includes the downstream-converging, tapered jet receiving surface 322 at an upper end thereof to be positioned near the location of where the jet 324 exits the workpiece 14 being processed. In some embodiments, the receptacle 250 is configured such that the jet receiving surface 322 is positioned immediately downstream of a workpiece 14 without any intervening structures, and in particular static structures.

As can be appreciated from FIG. 8, the jet 324 may deflect substantially from an initial trajectory as it passes through the workpiece 14, with the amount of deflection varying based on a variety of factors including, for example, cutting speed, material type and material thickness. For example, the jet 324 may deflect from a generally vertical initial trajectory to the path $P_2$ shown in FIG. 8 when cutting a workpiece 14 while moving the cutting head 222 in the direction indicated by the arrow labeled 326 or it may deflect to a greater or lesser degree from that of the path $P_2$ shown. Accordingly, the jet 324 may impinge on the jet receiving surface 322 at different locations along a cross-sectional profile of the tapered inlet 320.

In operation, the inlet feed component 300 is driven to rotate continuously or intermittently about the central axis $A_2$ such that impact of the jet 324 with the inlet feed component 300 is distributed continuously or intermittingly around the jet receiving surface 322 defined by the tapered inlet 320. In this manner, the jet 324 is directed to wear upon the jet receiving surface 322 over a tapered annular area such as, for example, the wear area 358 bound by the phantom lines shown in FIG. 8. Distributing the impact of the jet 324 over this relatively large wear area 358 advantageously prolongs the life of the inlet feed component 300 and reduces premature surface defects or irregularities (e.g., pits or pockets) that may cause fluid and abrasives (when present) to rebound out of the receptacle 250 and possibly damage the workpiece 14. In some embodiments, the wear area 358 may be at least one-half of a square inch, and in other embodiments, may be at least two square inches. In still yet other embodiments, the wear area 158 may be at least four square inches.

The inlet feed component 300 may be controlled to rotate continuously throughout a portion or an entirety of a cutting operation. Alternatively, the inlet feed component 300 may be controlled to rotate intermittently throughout a portion or an entirety of a cutting operation or rotate intermittently at times in between cutting or other processing operations or at otherwise regular or irregular time intervals. For example, the inlet feed component may be clocked 5, 10, 15 or 20 degrees between each of a series of processing operations or clocked 5, 10, 15 or 20 degrees after a given duration throughout a work day or shift. Irrespective of the particular control scheme, however, the inlet feed component 300 is rotatably driven to present a relatively large area of the jet receiving surface 322 for impingement by the jet 324 to distribute wear more evenly and prolong component life.

As previously described, the inlet feed component 300 may be positioned upstream of and in a linear relationship with a fluid distribution component 302, as shown in FIG. 8. The fluid distribution component 302 may include a central cavity 360 to receive fluid passing through the inlet feed component 300 and a plurality of discharge apertures 362 located about a perimeter of the fluid distribution component 302 in fluid communication with the central cavity 360, as indicated by the arrows labeled 364, to route fluid away from the jet receiving receptacle 250. The discharge apertures 362 may be configured to route fluid and abrasives (when present) to an outlet chamber 366 formed between an exterior surface 368 of the fluid distribution component 302 and an interior surface 369 of the housing 308.

The discharge apertures 362 may be in fluid communication with the central cavity 360 via a cavity 370 formed in an upper end 372 of jet arresting device 304 positioned downstream of the fluid distribution component 302. The cavity 370 of the jet arresting device 304 may be shaped to direct incoming fluid and abrasives (when present) radially outward and back upstream through the discharge apertures 362 in the periphery of the fluid distribution component 302 to the outlet chamber 366. From the outlet chamber 366, fluid and abrasives may be drawn out of the receptacle 250 by a vacuum device coupled to an outlet 374 of the receptacle 250 via a discharge or suction conduit 280 (FIG. 6). The discharged fluid and optional abrasives recovered by the jet receiving receptacle 250 may be reconditioned for reuse in the waterjet cutting system 10 (FIG. 1).

The distribution component 302 and the jet arresting device 304 may be generally cylindrical components which are insertable in an upstream direction in a common bore or cavity of the housing 308. The distribution component 302 may be held in place by the jet arresting device 304 and the jet arresting device 304 may be secured in place by a set screw (not visible) located within the housing 308 to engage the exterior surface 378 of the jet arresting device or by other fasteners or securing mechanisms. Advantageously, the jet arresting device 304 and the fluid distribution component 302 may be readily removed from the housing 308 for periodic inspection and/or replacement. Another seal element 379, such as, for example, an o-ring may be positioned between the housing 308 and the jet arresting device 304 to assist in preventing fluid from escaping between the housing 308 and the jet arresting device 304.

Although the jet arresting device 304 is shown as a unitary member which may be formed of or act as a sacrificial material to arrest the incoming jet 324, in other embodiments, the jet arresting device 304 may be provided in other forms and include known mechanisms for dissipating the energy of a high pressure fluid jet, such as, for example, a collection of balls, particles or other elements that absorb energy of the incoming jet 324 when interacting with the same.

Collectively, the inlet feed component 300, the fluid distribution component 302 and the jet arresting device 304 are particularly effective in forming a jet receiving receptacle 250 to capture a high pressure fluid jet or abrasive fluid jet in a compact form factor with exceptional durability. For instance, in some embodiments, a jet receiving receptacle 250 and sub-components thereof are sized to arrest the fluid jet 324 discharged from the nozzle 240 within the confines of a cylindrical envelop having a diameter of between about two inches and about four inches and a length between about five inches and about seven inches. In one particular embodiment, for example, the receptacle 250 has an overall length $L_2$ of about six inches and does not exceed a diameter $D_2$ of about three inches.

As previously described, the inlet feed component 300 is driven to rotate about the central axis $A_2$ such that the impact of the jet 324 with the inlet feed component 300 of the jet receiving receptacle 250 is distributed continuously or intermittingly along a perimeter of the jet receiving surface 222 defined by the tapered inlet 220. Accordingly, a fluid jet cutting system incorporating embodiments of the jet receiving receptacle 250 may include a drive mechanism adapted to rotate the inlet feed component about the central axis $A_2$. The drive mechanism may include, for example, hydraulic systems, pneumatic systems, electric drive motors and other drive components. For example, according to the embodiment shown in FIGS. 6 through 9, the drive mechanism includes a ratchet device 277 that includes or interacts with the drive element 346 coupled to the inlet feed component 300 to intermittently rotate the inlet feed component 300 about the central axis $A_2$. The ratchet device 277 may be securely attached to the housing 308 with threaded features 279 or other attachment devices. The housing 308 may include a cavity 281 therein for receiving at least a portion of the ratchet device 277.

As described earlier, the drive element 346 may be securely coupled to the inlet feed component 300 to move in unison therewith, as shown in FIGS. 8 and 9, or alternatively, may be formed integrally therewith. As best shown in FIG. 9, the drive element 346 includes a plurality of teeth 382 or other projections with interstitial gaps 384 around a periphery of at least a portion thereof. The teeth 382 and interstitial gaps 384 are configured to cooperate with a catch 386 that is drivable fore and aft by the ratchet device 277, and more particularly with a linear actuator 380 of the ratchet device 277. The catch 386 is spring-loaded toward a stop 388 by a spring element 390 such that when the linear actuator 380 is caused to extend the catch 386 engages the drive element 346 while being backed by the stop 388. Conversely, when the linear actuator 380 is caused to retract, the catch 386 is able to move toward a centerline of the actuator 380 against the force of the spring element 390 to pass by the drive element 346. Thus, as the linear actuator 380 moves fore and aft, the catch 386 engages and rotates the drive element 346 and hence inlet feed component 300 incrementally.

The fore and aft motion of the actuator 380 is represented by the arrow labeled 392 and the incremental motion of the inlet feed component is represented by the arrows labeled 394. To drive the linear actuator 380 of the ratchet device 277, a working or driving fluid, such as, for example, compressed air may be introduced alternatively to opposing sides of a piston in the actuator 380 via fittings or adapters 274, 276 and corresponding conduits 270, 272 (FIG. 6). As will be appreciated by those of ordinary skill in the relevant art, the amount of rotation of the inlet feed component 300 can be modified by, among other things, adjusting the number or spacing of the teeth 382 and a stroke of the actuator 380. In addition, it will be appreciated that other ratchet arrangements or drive mechanism may be provided to incrementally rotate the inlet feed component 300.

In some embodiments, the drive element 346 may be secured to or otherwise formed integrally with a reduced diameter section or sections 344, 347 of the inlet feed component 300 and sized such that the drive element 346 is positioned within an envelope defined by a diameter 334 of the upper or upstream end 332 of the inlet feed component 300 projected over a length thereof. In this manner, the drive element 346 and associated drive mechanism can be implemented without greatly affecting the overall working envelope of the jet receiving receptacle 250. This is particularly advantageous in that it enables the receptacle 250 to maintain a relatively compact form factor that can be manipulated about workpieces 14 having complex profiles, for example, without interference.

The various features and aspects described herein provide waterjet cutting systems 10 that are particularly well suited for processing workpieces 14 in an efficient manner and include jet receiving receptacles 50, 250 with compact and durable form factors to enable, among other things, processing workpieces 14 with reduced downtime related to the inspection, repair or replacement activities associated with fluid jet receiving receptacles or components thereof.

Although embodiments are shown in the figures in the context of processing a generic sheet-like workpiece 14, it is appreciated that the cutting head assemblies 66, 266, fluid jet receiving receptacles 50, 250 and waterjet cutting systems 10 incorporating the same described herein may be used to process a wide variety of workpieces having simple and complex shapes, including both planar and non-planar structures. Furthermore, as can be appreciated from the above descriptions, the cutting head assemblies 66, 266, fluid jet receiving receptacles 50, 250 and waterjet cutting systems 10 described herein are specifically adapted to generate a high-pressure fluid jet and capture the same in a relatively compact form factor or package that is particularly durable and which can substantially reduce or effectively eliminate rebounding of fluid and abrasives from the fluid jet receiving receptacle 50, 250. This can be particularly advantageous when cutting, for example, high-precision composite parts for aircraft or the like which have particularly stringent quality controls.

Still further, although example embodiments are shown in the figures as including certain drive mechanisms to controllably rotate the inlet feed component 100, 300 of the fluid jet receiving receptacles 50, 250, it is appreciated that in some embodiments the inlet feed components 100, 300 may be rotatably supported and oriented such that the impinging jet 124, 324 causes the inlet feed component 100, 300 to rotate without the aid of a mechanical drive mechanism. For example, with reference to FIGS. 4 and 8, the central axis $A_1$, $A_2$ of the inlet feed component 100, 300 may be oriented to tilt into or out of the page such that the direction of the incoming jet 124, 324 includes a component that is directed to drive the inlet feed component 100, 300 about the central axis $A_1$, $A_2$.

Figure 10:
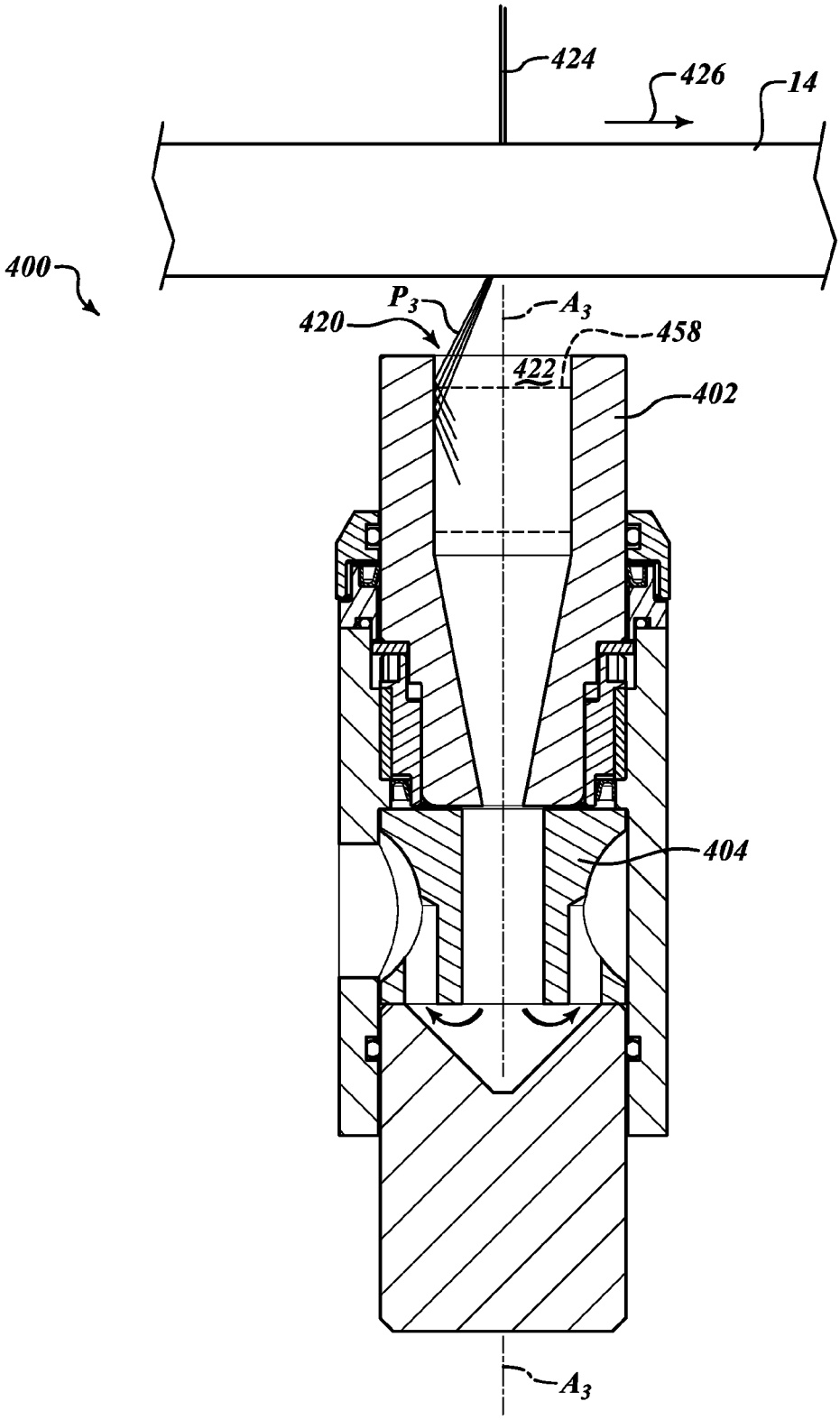
FIG. 10 is a cross-sectional view of a fluid jet receptacle, according to another embodiment, with an example workpiece positioned above the receptacle.

Although the embodiments of the inlet feed components 100, 300 of the fluid jet receiving receptacles 50, 250 described above include a tapered inlet that defines a jet receiving surface converging toward a central axis in a downstream direction, other embodiments may include a rotatable inlet feed component 402 of a fluid jet receiving receptacle 400 having an inlet 420 that is generally cylindrical and which extends at least a portion of a length of the inlet feed component 402 to form a jet receiving surface 422, as shown in FIG. 10. Accordingly, when a jet 424 deflects from an initial trajectory as it passes through a workpiece 14, such as, for example, the path $P_3$ shown in FIG. 10 caused by the source of the jet 424 moving in the direction indicated by the arrow labeled 426, the jet 424 may impinge on a cylindrically-shaped portion of the inlet feed component 402. Depending on a variety of factors, the jet 424 may impinge on the jet receiving surface 422 at different positions along a length of the inlet feed component 402 to generally define a wear area 458 in which the predominate amount of wear occurs. The fluid and abrasives (when provided) of the jet 424 may be deflected by the jet receiving surface 422 and routed downstream to a rotatably static fluid distribution component 404 for subsequent collection and discharge in a manner similar to other described embodiments. The inlet feed component 402 may be a single unitary member that is rotatably driven about a central axis $A_3$ in a continuous or intermittent manner and it may be configured to be positioned immediately adjacent the workpiece 14 without any intervening or intermediate structures, as shown, for example, in FIG. 10.

Figure 11:
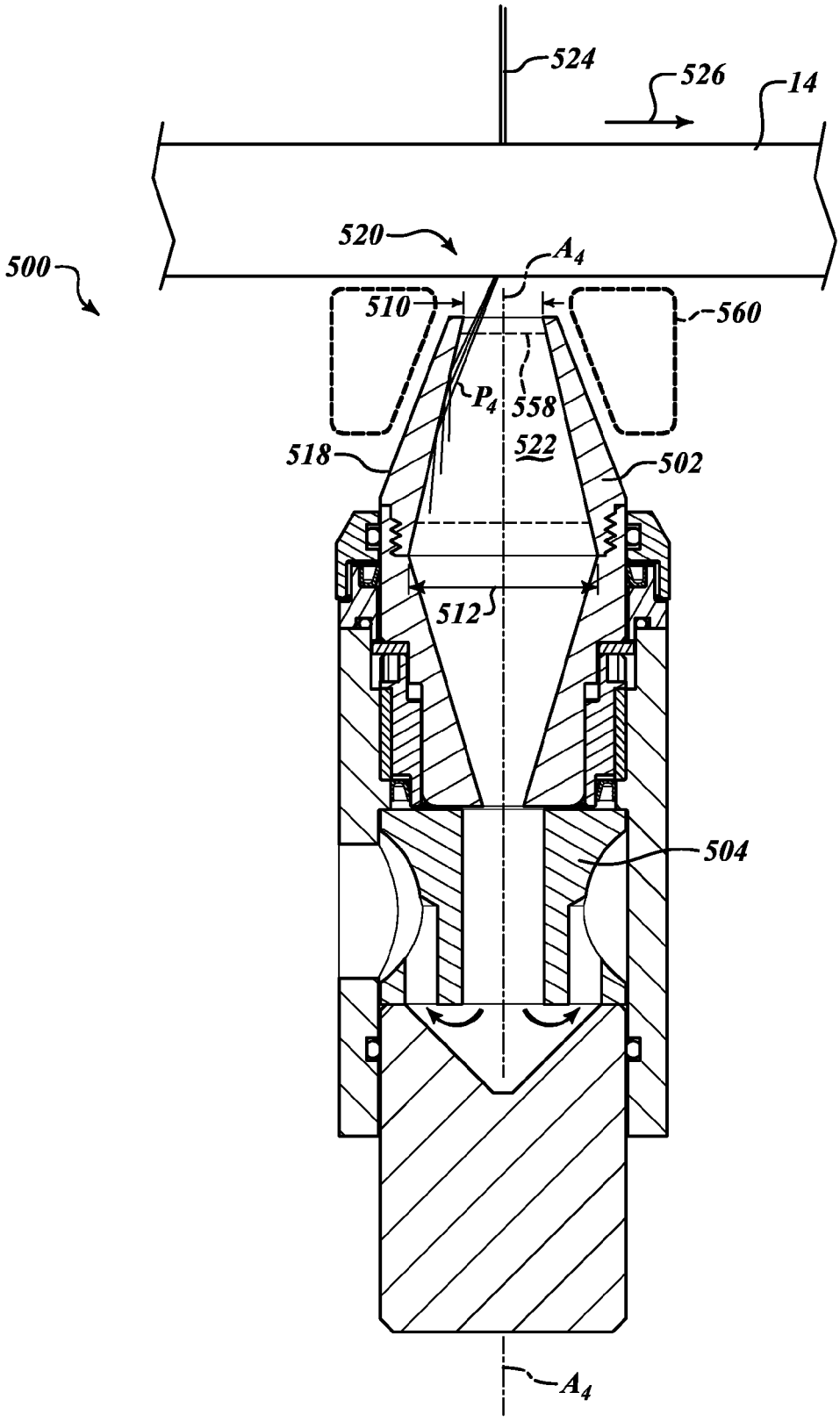
FIG. 11 is a cross-sectional view of a fluid jet receptacle, according to yet another embodiment, with an example workpiece positioned above the receptacle.

According to other embodiments, a rotatable inlet feed component 502 of a fluid jet receiving receptacle 500 may be provided with an inlet 520 that includes at least a leading portion tapered in a manner that diverges in a downstream direction to form a jet receiving surface 522, as shown, for example, in FIG. 11. Accordingly, a perimeter (in some instances a diameter 510) of the upstream end of the inlet 520 is less than a perimeter (in some instances diameter 512) of a downstream portion of the inlet 520. Further, an exterior surface 518 of the inlet feed component 502 may taper in a similar manner, thus forming a generally tapered nose converging in an upstream direction which advantageously provides a clearance zone 560 near the inlet feed component 502. This enables the jet receiving receptacle 500 to be manipulated relative to the workpiece 14 in a manner which may substantially reduce interference between the workpiece 14 and jet receiving receptacle 500.

When a jet 524 deflects from an initial trajectory as it passes through a workpiece 14, such as, for example, the path $P_4$ shown in FIG. 11 caused by the source of the jet 524 moving in the direction indicated by the arrow labeled 526, the jet 524 may impinge on a tapered portion of the jet receiving surface 522. Depending on a variety of factors, the jet 524 may impinge on the jet receiving surface 522 at different positions along a length of the inlet feed component 502 to generally define a wear area 558 in which the predominate amount of wear occurs. The contents of the jet 524 may be deflected by the jet receiving surface 522 and routed downstream to a rotatably static fluid distribution component 504 for subsequent collection and discharge in a manner similar to other described embodiments. The inlet feed component 502 may be a single unitary member that is rotatably driven in a continuous or intermittent manner about a central axis $A_4$ and it may be configured to be positioned immediately adjacent the workpiece 14 without any intervening or intermediate structures, as shown, for example, in FIG. 11.

Figure 12:
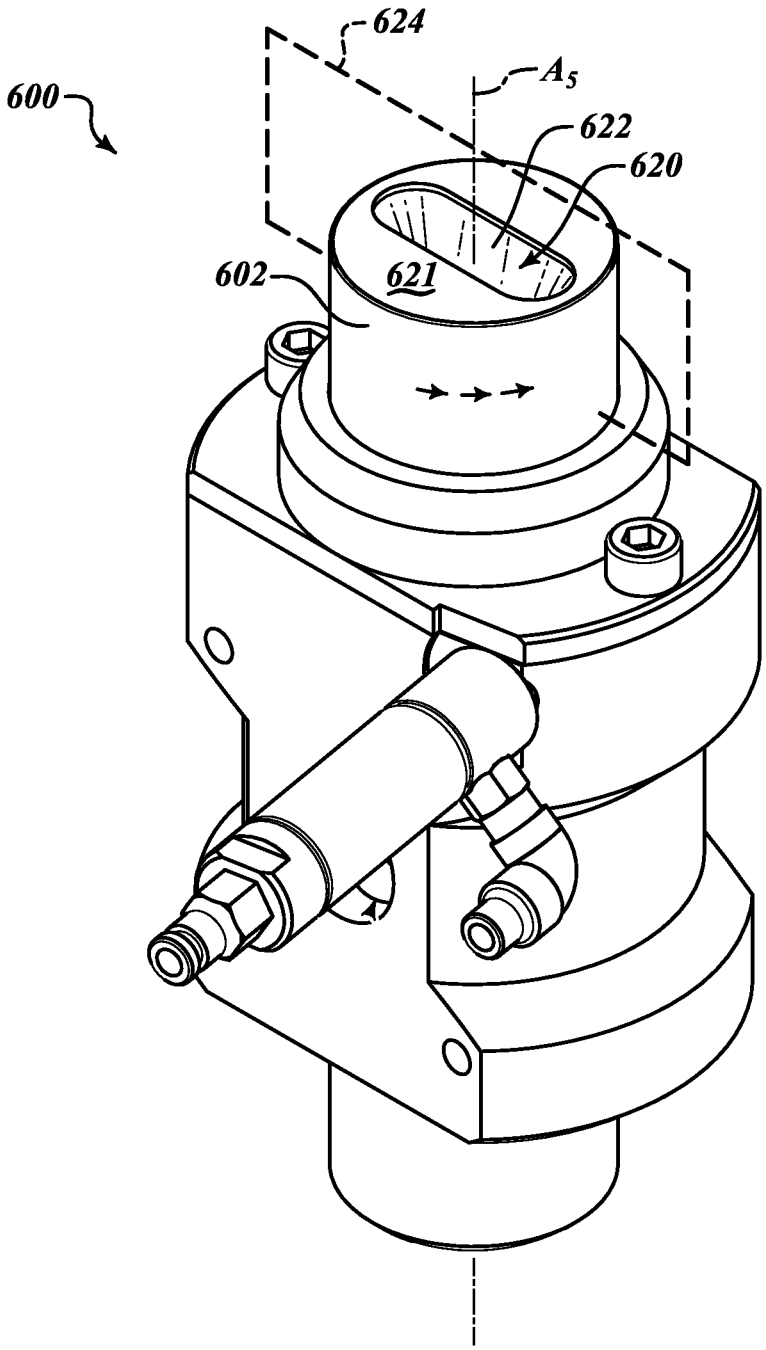
FIG. 12 an isometric view of a fluid jet receptacle according to still yet another embodiment.

With reference to FIG. 12, according to some embodiments, a fluid jet receiving receptacle 600 may be provided with a rotatable inlet feed component 602 which includes an inlet 620 that is non-circular. For example, the inlet 620 may include an oblong or oval shaped aperture that extends in a longitudinal direction in a tapered or non-tapered manner to define a jet receiving surface 622. The entrance of the inlet 620 may extend transversely relative to a central axis $A_5$ in one direction greater than another direction. For instance, the entrance to the inlet 620 in FIG. 12 is an oval which extends across an upper surface 621 of the inlet feed component 602 and is generally symmetric about reference plane 624. In such embodiments, the inlet feed component 602 may be controllably clocked or indexed during operation to maintain the reference plane 624 in general alignment with a deflected jet that impinges on the jet receiving surface 622 after passing through a workpiece. For example, the inlet feed component 602 may remain stationary while cutting in a first direction and then rotated several degrees when the cutting path makes a corresponding change in direction. In this manner, the jet may remain aligned with a particularly portion of the jet receiving surface 622 during operation. While the illustrated embodiment of FIG. 12 includes an inlet 620 having an oval entrance which tapers in a downstream direction, the inlet 620 may have an entrance of other oblong shapes, including symmetric and asymmetric shapes.

Moreover, the various embodiments described above can be combined to provide further embodiments. These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

The invention claimed is:

1. A fluid jet system adapted to generate a fluid jet under high pressure operating conditions to process a workpiece, the fluid jet system comprising:

a nozzle having a fluid jet outlet to discharge the fluid jet;

a jet receiving receptacle positioned opposite the nozzle to receive the fluid jet during a workpiece processing operation, the jet receiving receptacle including an inlet feed component having a tapered inlet that defines a jet receiving surface about a central axis, the jet receiving surface converging toward the central axis in a downstream direction; and a drive mechanism adapted to rotate the inlet feed component incrementally about the central axis such that impact of the fluid jet with the inlet feed component of the jet receiving receptacle is distributed around the jet receiving surface defined by the tapered inlet.

2. The fluid jet system of claim 1 wherein the jet receiving surface defined by the tapered inlet of inlet feed component is frustoconical and has an included angle between about twenty degrees and about seventy degrees.

3. The fluid jet system of claim 1 wherein the jet receiving receptacle is coupled to move in unison with the nozzle by a rigid support arm, the rigid support arm shaped to define a workpiece clearance envelope between the nozzle and the jet receiving receptacle.

4. The fluid jet system of claim 1 wherein the jet receiving receptacle is a compact receptacle sized to arrest the fluid jet discharged from the nozzle within the confines of a cylindrical envelop having a diameter of between about two inches and about four inches and a length between about five inches and about seven inches.

5. A fluid jet system adapted to generate a fluid jet under high pressure operating conditions to process a workpiece, the fluid jet system comprising:

a nozzle having a fluid jet outlet to discharge the fluid jet;

a jet receiving receptacle positioned opposite the nozzle to receive the fluid jet during a workpiece processing operation, the jet receiving receptacle including an inlet feed component having a tapered inlet that defines a jet receiving surface about a central axis, the jet receiving surface converging toward the central axis in a downstream direction; and a drive mechanism adapted to rotate the inlet feed component about the central axis such that impact of the fluid jet with the inlet feed component of the jet receiving receptacle is distributed continuously or intermittingly around the jet receiving surface defined by the tapered inlet, and the drive mechanism including a vane adapted to rotate the inlet feed component about the central axis in response to a driving fluid.

6. The fluid jet system of claim 5, further comprising:

a housing having a vane chamber to enclose the vane, a driving fluid inlet in fluid communication with the vane chamber to feed the driving fluid toward the vane and a driving fluid outlet in fluid communication with the vane chamber to discharge the driving fluid after the driving fluid interacts with the vane and rotates the inlet feed component about the central axis.

7. The fluid jet system of claim 5 wherein the inlet feed component includes an upper tubular section having a first diameter and a lower tubular section having a second diameter less than the first diameter, and wherein the vane is positioned around the lower tubular section and sized such that the vane is positioned within an envelope defined by the first diameter projected over a length of the inlet feed component.

8. The fluid jet system of claim 5 wherein the drive mechanism includes a pair of bearings and a pair of annular wear rings, the vane located between the pair of bearings and between the pair of annular wear rings.

9. A fluid jet system adapted to generate a fluid jet under high pressure operating conditions to process a workpiece, the fluid jet system comprising:

a nozzle having a fluid jet outlet to discharge the fluid jet;

a jet receiving receptacle positioned opposite the nozzle to receive the fluid jet during a workpiece processing operation, the jet receiving receptacle including an inlet feed component having a tapered inlet that defines a jet receiving surface about a central axis, the jet receiving surface converging toward the central axis in a downstream direction; and a drive mechanism adapted to rotate the inlet feed component about the central axis such that impact of the fluid jet with the inlet feed component of the jet receiving receptacle is distributed continuously or intermittingly around the jet receiving surface defined by the tapered inlet, and the drive mechanism including a ratchet device coupled to the inlet feed component to incrementally rotate the inlet feed component about the central axis.

10. The fluid jet system of claim 9 wherein ratchet device includes a linear actuator and a catch configured to incrementally rotate the inlet feed component with each actuation of the linear actuator.

11. The fluid jet system of claim 10 wherein the ratchet device further includes an annular toothed drive element adapted to move with the inlet feed component, and wherein the catch engages a respective tooth of the annular toothed drive element with each actuation of the linear actuator to incrementally rotate the inlet feed component about the central axis.

12. The fluid jet system of claim 11 wherein the inlet feed component includes an upper tubular section having a first diameter and a lower tubular section having a second diameter less than the first diameter, and wherein the annular toothed drive element is positioned around the lower tubular section and sized such that the annular toothed drive element is positioned within an envelope defined by the first diameter projected over a length of the inlet feed component.

13. A fluid jet system adapted to generate a fluid jet under high pressure operating conditions to process a workpiece, the fluid jet system comprising:

a nozzle having a fluid jet outlet to discharge the fluid jet;

a jet receiving receptacle positioned opposite the nozzle to receive the fluid jet during a workpiece processing operation, the jet receiving receptacle including an inlet feed component having a tapered inlet that defines a jet receiving surface about a central axis, the jet receiving surface converging toward the central axis in a downstream direction, and a fluid distribution component positioned downstream of the inlet feed component, the fluid distribution component including a central cavity to receive fluid passing through the inlet feed component and a plurality of discharge apertures located about a perimeter of the fluid distribution component in fluid communication with the central cavity to route fluid away from the jet receiving receptacle; and a drive mechanism adapted to rotate the inlet feed component about the central axis such that impact of the fluid jet with the inlet feed component of the jet receiving receptacle is distributed continuously or intermittingly around the jet receiving surface defined by the tapered inlet.

14. The fluid jet system of claim 13 wherein the jet receiving receptacle further includes a jet arresting device positioned downstream of the fluid distribution component to assist in dissipating energy of the fluid jet when the fluid jet is discharged by the nozzle into the jet receiving receptacle.

15. A fluid jet system adapted to generate a fluid jet under high pressure operating conditions to process a workpiece, the fluid jet system comprising:

a nozzle having a fluid jet outlet to discharge the fluid jet;

a jet receiving receptacle positioned opposite the nozzle to receive the fluid jet during a workpiece processing operation, the jet receiving receptacle including an inlet feed component having a tapered inlet that defines a jet receiving surface about a central axis, the jet receiving surface converging toward the central axis in a downstream direction, and the jet receiving receptacle having a three-stage construction that includes the inlet feed component, a fluid distribution component and a jet arresting device to assist in dissipating energy of the fluid jet when the fluid jet is discharged by the nozzle into the jet receiving receptacle, the fluid distribution component positioned between the inlet feed component and the jet arresting device, the fluid distribution component including a central cavity to receive fluid passing through the inlet feed component and a plurality of discharge apertures located about a perimeter of the fluid distribution component in fluid communication with the central cavity via a cavity of the jet arresting device to route fluid away from the jet receiving receptacle; and a drive mechanism adapted to rotate the inlet feed component about the central axis such that impact of the fluid jet with the inlet feed component of the jet receiving receptacle is distributed continuously or intermittingly around the jet receiving surface defined by the tapered inlet.

16. A jet receiving receptacle coupleable to a high pressure fluid jet system opposite a nozzle thereof to receive a fluid jet discharged from the nozzle during a workpiece processing operation, the jet receiving receptacle comprising:

an inlet feed component having a tapered inlet that defines a jet receiving surface about a central axis, the jet receiving surface converging toward the central axis in a downstream direction to receive the fluid jet and direct the fluid jet downstream and toward the central axis; and a drive mechanism adapted to rotate the inlet feed component about the central axis such that impact of the fluid jet with the inlet feed component is distributed continuously or intermittingly around the jet receiving surface defined by the tapered inlet, and the drive mechanism including a vane adapted to continuously rotate the inlet feed component about the central axis in response to a driving fluid.

17. A jet receiving receptacle coupleable to a high pressure fluid jet system opposite a nozzle thereof to receive a fluid jet discharged from the nozzle during a workpiece processing operation, the jet receiving receptacle comprising:

an inlet feed component having a tapered inlet that defines a jet receiving surface about a central axis, the jet receiving surface converging toward the central axis in a downstream direction to receive the fluid jet and direct the fluid jet downstream and toward the central axis; and a drive mechanism adapted to rotate the inlet feed component about the central axis such that impact of the fluid jet with the inlet feed component is distributed continuously or intermittingly around the jet receiving surface defined by the tapered inlet, and the drive mechanism including a ratchet device coupled to the inlet feed component to incrementally rotate the inlet feed component about the central axis.

18. A jet receiving receptacle coupleable to a high pressure fluid jet system opposite a nozzle thereof to receive a fluid jet discharged from the nozzle during a workpiece processing operation, the jet receiving receptacle comprising:

an inlet feed component having a tapered inlet that defines a jet receiving surface about a central axis, the jet receiving surface converging toward the central axis in a downstream direction to receive the fluid jet and direct the fluid jet downstream and toward the central axis, and the jet receiving receptacle having a three-stage construction that includes the inlet feed component, a fluid distribution component and a jet arresting device to assist in dissipating energy of the fluid jet when the fluid jet is discharged by the nozzle into the jet receiving receptacle, the fluid distribution component positioned between the inlet feed component and the jet arresting device along the central axis, the fluid distribution component including a central cavity to receive fluid passing through the inlet feed component and a plurality of discharge apertures located about a perimeter of the fluid distribution component in fluid communication with the central cavity via a cavity of the jet arresting device to route fluid away from the jet receiving receptacle; and a drive mechanism adapted to rotate the inlet feed component about the central axis such that impact of the fluid jet with the inlet feed component is distributed continuously or intermittingly around the jet receiving surface defined by the tapered inlet.

19. A jet receiving receptacle coupleable to a high pressure fluid jet system opposite a nozzle thereof to receive a fluid jet discharged from the nozzle during a workpiece processing operation, the jet receiving receptacle comprising:

an inlet feed component having a tapered inlet that defines a jet receiving surface about a central axis, the jet receiving surface converging toward the central axis in a downstream direction to receive the fluid jet and direct the fluid jet downstream and toward the central axis; and a housing having a cavity to receive and rotatably support the inlet feed component such that the fluid jet discharged from the nozzle interacts with the jet receiving surface to impart rotation to the inlet feed component.

20. A method of capturing a fluid jet generated by a high pressure fluid jet system during the processing of a workpiece, the method including:

causing the fluid jet to impinge directly on a jet receiving surface defined by a tapered inlet of an inlet feed component after the fluid jet acts on the workpiece, the jet receiving surface converging toward a central axis of the tapered inlet in a downstream direction to direct the fluid jet downstream and toward the central axis; and rotating the inlet feed component intermittently about the central axis such that impact of the fluid jet with the inlet feed component is distributed around the jet receiving surface defined by the tapered inlet of the inlet feed component.

21. A method of capturing a fluid jet generated by a high pressure fluid jet system during the processing of a workpiece, the method including:

causing the fluid jet to impinge directly on a jet receiving surface defined by a tapered inlet of an inlet feed component after the fluid jet acts on the workpiece, the jet receiving surface converging toward a central axis of the tapered inlet in a downstream direction to direct the fluid jet downstream and toward the central axis; and continuously rotating the inlet feed component with a driving fluid about the central axis such that impact of the fluid jet with the inlet feed component is distributed around the jet receiving surface defined by the tapered inlet of the inlet feed component.

22. A method of capturing a fluid jet generated by a high pressure fluid jet system during the processing of a workpiece, the method including:

causing the fluid jet to impinge directly on a jet receiving surface defined by a tapered inlet of an inlet feed component after the fluid jet acts on the workpiece, the jet receiving surface converging toward a central axis of the tapered inlet in a downstream direction to direct the fluid jet downstream and toward the central axis; and ratcheting the inlet feed component to rotate incrementally about the central axis such that impact of the fluid jet with the inlet feed component is distributed around the jet receiving surface defined by the tapered inlet of the inlet feed component.

23. A jet receiving receptacle coupleable to a high pressure fluid jet system opposite a nozzle thereof to receive a fluid jet discharged from the nozzle during a workpiece processing operation, the jet receiving receptacle comprising:

an inlet feed component having a tapered inlet that defines a jet receiving surface about a central axis, the jet receiving surface diverging away from the central axis in a downstream direction to receive the fluid jet and direct the fluid jet downstream; and a drive mechanism adapted to rotate the inlet feed component about the central axis such that impact of the fluid jet with the inlet feed component is distributed continuously or intermittingly around the jet receiving surface defined by the tapered inlet.

24. The jet receiving receptacle of claim 23 wherein the jet receiving surface defined by the tapered inlet of the inlet feed component is frustoconical, a first diameter at an upstream end of the jet receiving surface being smaller than a second diameter at a downstream end of the jet receiving surface.

25. A jet receiving receptacle coupleable to a high pressure fluid jet system opposite a nozzle thereof to receive a fluid jet discharged from the nozzle during a workpiece processing operation, the jet receiving receptacle comprising:

a unitary inlet feed component having an inlet that defines a jet receiving surface about a central axis, at least a portion of the jet receiving surface being cylindrical;

a fluid distribution component positioned immediately downstream of the unitary inlet feed component, the fluid distribution component including a central cavity to receive fluid passing through the inlet feed component and at least one discharge aperture in fluid communication with the central cavity to route fluid away from the jet receiving receptacle; and a drive mechanism adapted to rotate the inlet feed component incrementally about the central axis such that impact of the fluid jet with the inlet feed component is distributed around the jet receiving surface.

* * * * *